US012459763B2

(12) United States Patent
Wanibe

(10) Patent No.: US 12,459,763 B2
(45) Date of Patent: Nov. 4, 2025

(54) FEEDING CASSETTE AND RECORDING DEVICE

(71) Applicant: SEIKO EPSON CORPORATION, Tokyo (JP)

(72) Inventor: Akihisa Wanibe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 233 days.

(21) Appl. No.: 18/314,003

(22) Filed: May 8, 2023

(65) Prior Publication Data

US 2023/0365364 A1 Nov. 16, 2023

(30) Foreign Application Priority Data

May 10, 2022 (JP) ..... 2022-077392

(51) Int. Cl.
*B65H 1/14* (2006.01)
*B65H 1/26* (2006.01)

(52) U.S. Cl.
CPC ..... *B65H 1/14* (2013.01); *B65H 1/266* (2013.01); *B65H 2405/111* (2013.01); *B65H 2405/1117* (2013.01); *B65H 2405/141* (2013.01); *B65H 2405/1412* (2013.01); *B65H 2405/31* (2013.01);

(Continued)

(58) Field of Classification Search
CPC . B65H 1/08; B65H 1/14; B65H 1/266; B65H 2405/111; B65H 2405/1112; B65H 2405/11151; B65H 2405/11161; B65H 2405/1117; B65H 2405/113; B65H 2405/1132; B65H 2405/1134; B65H 2405/1136; B65H 2405/14; B65H 2405/141; B65H 2405/1412; B65H 2405/142; B65H 2405/31; B65H 2511/12; B65H 2511/22; B65H 2515/81
See application file for complete search history.

(56) References Cited

U.S. PATENT DOCUMENTS 4,874,159 A * 10/1989 Maeno ..... B65H 1/266 271/171
2008/0296832 A1* 12/2008 Kotera ..... B65H 1/266 271/145

(Continued)

FOREIGN PATENT DOCUMENTS

JP 2016-135712 A 7/2016

*Primary Examiner* — Prasad V Gokhale
(74) *Attorney, Agent, or Firm* — WORKMAN NYDEGGER

(57) ABSTRACT

A feeding cassette includes a hopper, a side guide, and a lift plate. The lift plate rotates with one end portion thereof serving as a rotational fulcrum, and, using a tip portion thereof, supports an under surface of the hopper from below and moves the hopper upward. The hopper includes a constricted portion for reinforcement protruding to an under side, in at least an extension portion. The constricted portion for reinforcement includes a supporting constricted portion with which the tip portion of the lift plate comes into contact when the lift plate supports the under surface of the hopper in a swingable range of the hopper. The supporting constricted portion includes a first constricted portion that is a path including a component in a feeding direction, and at least a part of the first constricted portion is provided in the extension portion. The lift plate supports the first constricted portion.

15 Claims, 11 Drawing Sheets

(52) U.S. Cl.
CPC ..... *B65H 2511/12* (2013.01); *B65H 2511/22* (2013.01); *B65H 2515/81* (2013.01)

(56) References Cited

U.S. PATENT DOCUMENTS

| | | | | |
|---|---|---|---|---|
| 2016/0060050 | A1* | 3/2016 | Iwama | B65H 1/14 271/147 |
| 2016/0214809 | A1 | 7/2016 | Waragai et al. | |
| 2017/0031291 | A1* | 2/2017 | Nishioka | B65H 1/18 |
| 2018/0278774 | A1* | 9/2018 | Morita | B65H 1/266 |

* cited by examiner

FEEDING CASSETTE AND RECORDING DEVICE

The present application is based on, and claims priority from JP Application Serial Number 2022-077392, filed Mar. 10, 2022, the disclosure of which is hereby incorporated by reference herein in its entirety.

BACKGROUND

1. Technical Field

The present disclosure relates to a feeding cassette that accommodates, in a stacked state, media to be fed, and to a recording device provided with the feeding cassette.

2. Related Art

JP-A-2016-135712 discloses a feeding cassette provided with a hopper that pushes a stacked media bundle upward, toward a feed roller disposed in a printer body. The feeding cassette is provided with a side fence (side guide) for regulating the position of the medium in the width direction. The side fence is provided so as to be movable in the width direction of the medium, which is a sheet or the like, with respect to a tray constituting the feeding cassette. By moving the side fence in the width direction in accordance with the size of the medium, the position of the media bundle stacked on the feeding cassette is determined in the width direction. The plate shape hopper is provided at a bottom portion of the tray of the feeding cassette so as to be rotatable, with one end of the hopper serving as a rotational fulcrum. The tip of a rotating lift member is engaged with the under surface of the hopper. When feeding the uppermost medium of the media bundle, as a result of the lift member being rotated by the power of a drive source, the hopper rotates with the one end thereof serving as the rotational fulcrum, and is disposed from a retracted position to a feeding position. In a state where the hopper is disposed at the feeding position, the uppermost medium of the media bundle is pressed against the feed roller (feeding roller). When the feed roller rotates in this state, the uppermost medium of the media bundle in the feeding cassette is fed toward a recording unit.

However, in a recording device disclosed in JP-A-2016-135712, when a movement range of the side fence (side guide) is increased to an inner side in the width direction in order to regulate the medium having a narrower medium width, a width of a central portion of the hopper becomes narrower, and the rigidity of the hopper becomes lower than that of the related art. Alternatively, also when the thickness of the hopper is reduced in correspondence with a reduction in thickness of the feeding cassette, or when the material is changed to that of a lower rigidity for reasons such as cost, there is a problem in that the rigidity of the hopper decreases. When the rigidity of the hopper decreases, there is a risk that when the hopper on which a plurality of sheets are stacked is moved upward, an extension portion extending in the width direction at a downstream portion in a feeding direction of the hopper may be bent downward, and may collide with a wall surface of the feeding cassette when the uppermost medium is fed toward the recording unit, thus resulting in a feeding failure.

SUMMARY

A feeding cassette for solving the problem described above includes a cassette body configured to accommodate a medium in a stacked state, a hopper disposed in the cassette body, the medium being stacked on the hopper, and the hopper being configured to swing with respect to the cassette body, a side guide configured to regulate a position of the medium in a width direction and to move in the width direction, and a lift plate configured to rotate around a rotational movement shaft parallel to the width direction with one end portion of the lift plate serving as a rotational fulcrum, to support an under surface of the hopper from below and move the hopper upward, using a tip portion, the tip portion being an end portion of the lift plate on an opposite end from the rotational fulcrum. The hopper includes a central portion positioned at a center in the width direction, and an extension portion extending to both sides in the width direction from a downstream portion of the central portion in a feeding direction in which the medium is fed. The hopper includes a constricted portion for reinforcement protruding to an under side, in at least the extension portion, and the constricted portion for reinforcement includes a supporting constricted portion with which the tip portion of the lift plate comes into contact when supporting the under surface of the hopper in a swingable range of the hopper. The supporting constricted portion includes a first constricted portion in a path including a component in the feeding direction, at least a part of the first constricted portion being provided in the extension portion, and the lift plate supports the first constricted portion over at least a part of the swingable range of the hopper.

A recording device for solving the problem described above includes the feeding cassette described above, and a recording unit configured to perform recording on a medium fed from the feeding cassette.

DESCRIPTION OF EXEMPLARY EMBODIMENTS

Embodiments will be described below with reference to the accompanying drawings. A recording device 11 is, for example, a multifunction device. The recording device 11 has, for example, a scan function and a copy function in addition to a recording function. The recording device 11 is provided with a feeding cassette 15 configured to be able to accommodate media M (refer to FIG. 2) as a recording target. The feeding cassette 15 has a function of accommodating a plurality of the media M (refer to FIG. 2) in a stacked state, the media M being a recording target when the recording device 11 performs recording on a medium. The recording device 11 has a feeding function of sequentially feeding the media M, one by one from the uppermost medium M, from a media bundle MB formed by the plurality of media M accommodated in the feeding cassette 15.

Figure 2:
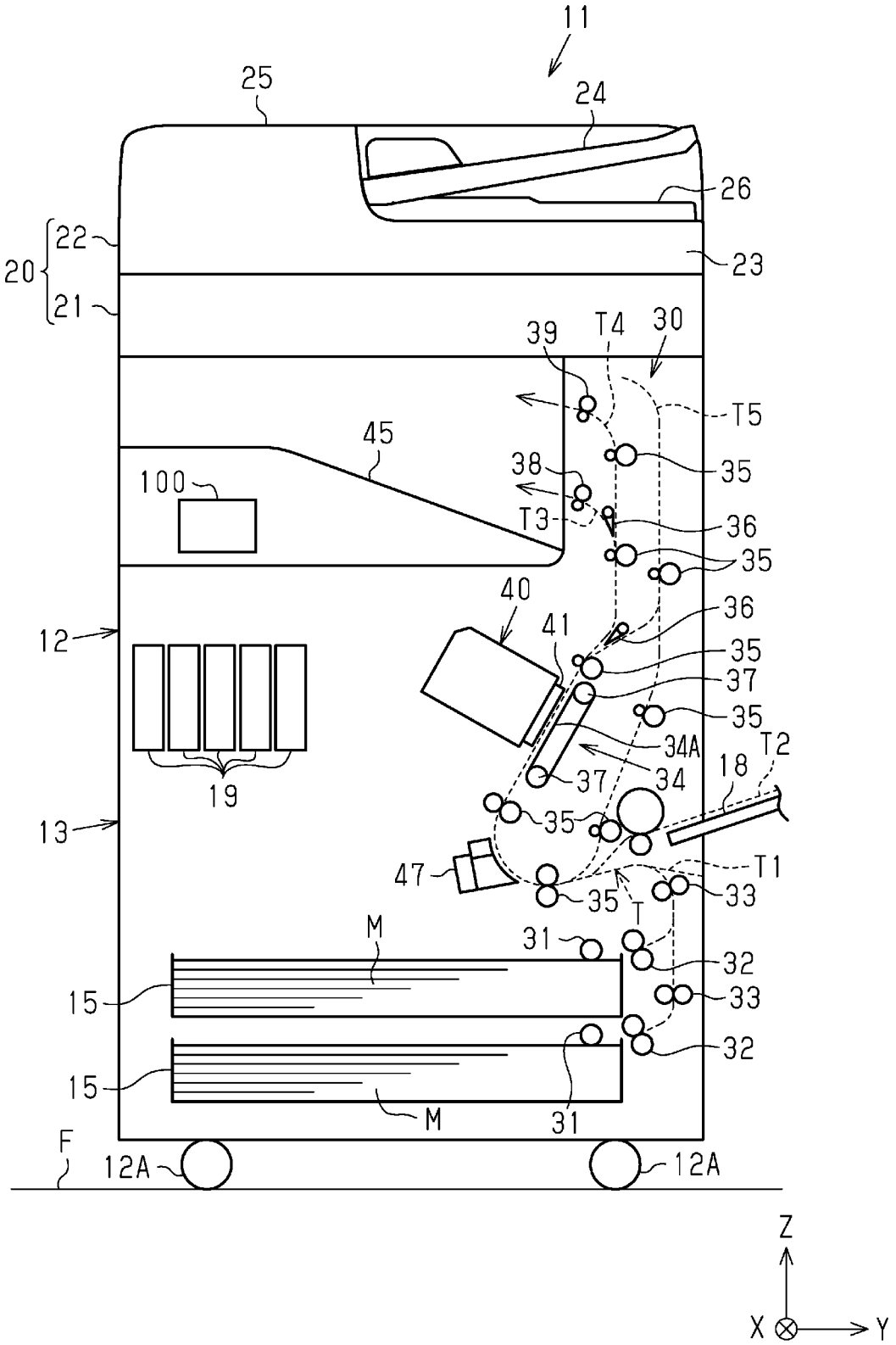
FIG. 2 is a schematic side cross-sectional view illustrating an internal configuration of the recording device.

In the drawings, it is assumed that the recording device 11 is placed on a horizontal floor surface F (refer to FIG. 2). A virtual axis orthogonal to the floor surface F of the recording device 11 is a Z-axis, and, of the Z-axis, one side of the recording device 11 with respect to the floor surface F is a positive Z side and the opposite side is a negative Z side. Further, two virtual axes parallel to the floor surface F and orthogonal to each other are an X-axis and a Y-axis, respectively. Directions parallel to the X-axis, the Y-axis, and the Z-axis are referred to as an X direction, a Y direction, and a Z direction, respectively. The X direction includes both of a positive X direction and a negative X direction. The Y direction includes both of a positive Y direction and a negative Y direction. The Z direction includes both of a positive Z direction and a negative Z direction. The Z direction parallel to the Z-axis is also referred to as a vertical direction Z. The X-axis is parallel to a depth direction of the recording device 11. Further, the X direction is a direction parallel to the width direction of the medium M constituting the media bundle MB (see FIG. 2) accommodated in the feeding cassette 15. Therefore, the width direction of the medium M is also referred to as a width direction X.

Further, since the Y direction is the direction in which the medium M accommodated in the feeding cassette 15 is fed out, the Y direction is also referred to as a feeding out direction Y. Note that when a hopper 61 to be described later, on which the media bundle MB is placed in the feeding cassette 15, is tilted to an angle corresponding to a media loading amount, a feeding direction FD in which the medium M is fed from the feeding cassette 15 changes in accordance with the media loading amount in the feeding cassette 15. For this reason, the feeding direction of the medium M that changes in accordance with the media loading amount in the feeding cassette 15 is referred to as the feeding direction FD. The feeding out direction Y corresponds to a direction obtained by projecting the feeding direction FD onto a horizontal plane. Here, the front surface of the recording device 11 is a surface on a side where an operation unit 14 is located that is operated by a user to impart instructions to the recording device 11.

Configuration of Recording Device 11

Figure 1:
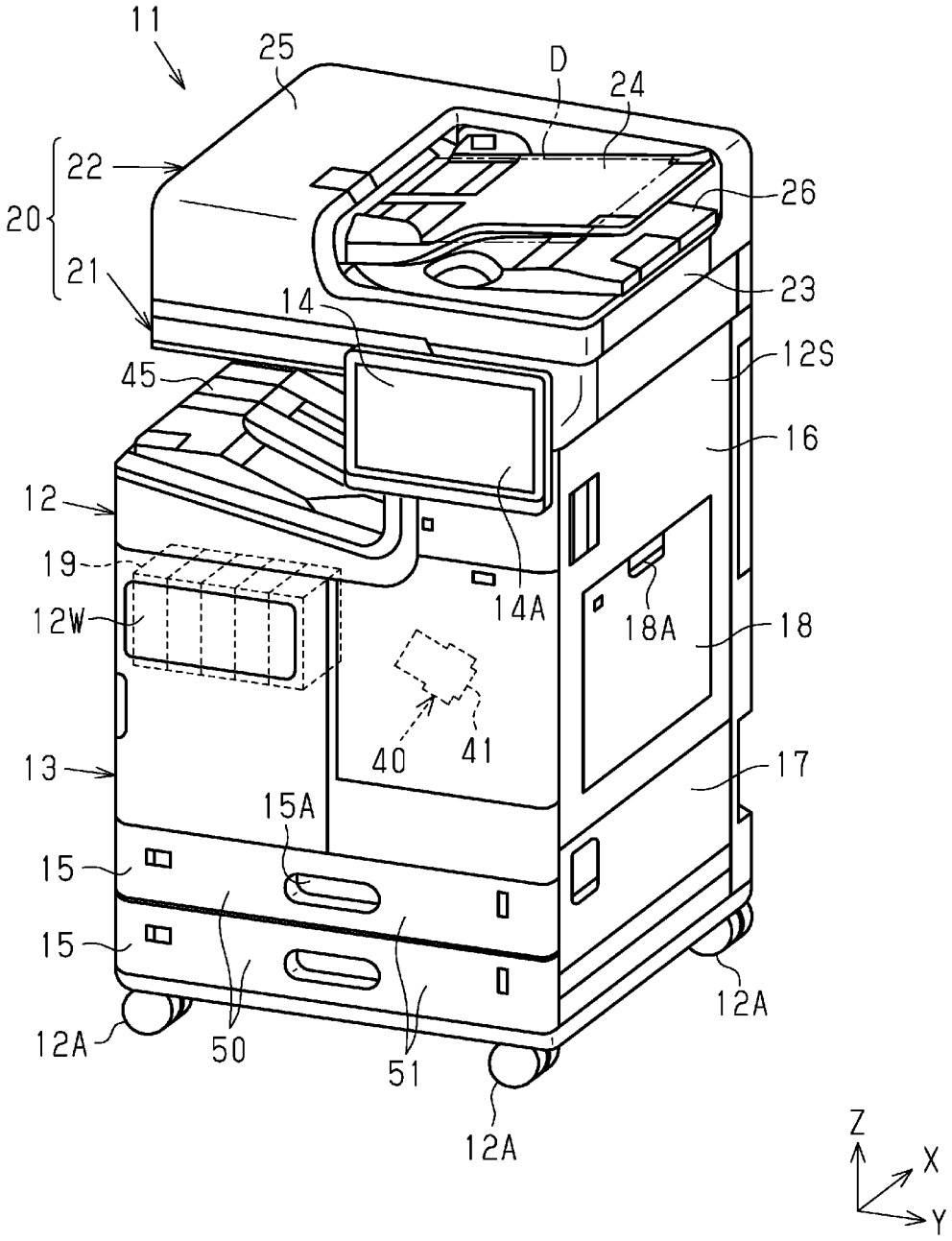
FIG. 1 is a perspective view illustrating a recording device according to a first embodiment.

The recording device 11 illustrated in FIG. 1 has the plurality of functions including an image reading function (the scan function) of reading a document D and outputting image data, the copy function of recording, on the medium M, the image obtained by reading the document D, and the recording function of recording characters and images on the medium M. Note that the recording device 11 may also have a facsimile function.

As illustrated in FIG. 1, the recording device 11 is provided with a device main body 12 having a cuboid shape, and a scanner unit 20 disposed at the upper portion of the device main body 12. The recording device 11 is provided with a plurality of casters 12A at the bottom of the device main body 12. In the recording device 11 illustrated in FIG. 1, a printer unit 13 is constituted by the device main body 12. The recording device 11 is provided with the printer unit 13 and the scanner unit 20 in order from the lower side in the vertical direction Z.

The scanner unit 20 has the function of reading the image of the document D. The scanner unit 20 is provided with a document table 21 on which the document D is placed, and an auto document feeder (ADF) 22 that automatically feeds the document D. The auto document feeder 22 is mounted on an upper portion of a document table cover 23 that is opened and closed with respect to the document table 21.

The scanner unit 20 is provided with a feed system and a flatbed system as a document reading system. The auto document feeder 22 is provided with a document tray 24, a feeding mechanism 25 that feeds the document D that is placed on the document tray 24 and that is indicated by a two-dot chain line in FIG. 1, and a discharge tray 26 to which the document D read by the feed system is discharged. The feed system is a method of reading the document D fed by the auto document feeder 22. On the other hand, the flatbed system is a method of reading the document D placed on a glass surface (not illustrated) forming an upper surface of the document table 21 which is exposed when the auto document feeder 22 is opened, in a state in which the document table cover 23 is closed.

Further, the operation unit 14 that is operated when imparting an instruction to the recording device 11 is provided at the upper portion of the front surface of the device main body 12. The operation unit 14 may be an operation panel including a display unit 14A. The display unit 14A may include, for example, a screen constituted by a touch panel. The touch panel is a display panel capable of imparting the instruction to the recording device 11 as a result of the screen being touched. Further, the operation unit 14 may include operation buttons or may be configured to be constituted by the operation buttons alone.

The recording device 11 is provided with the feeding cassette 15 configured to be able to accommodate the plurality of media M. In the feeding cassette 15, the plurality of media M (refer to FIG. 2) are stored in the stacked state. The recording device 11 is provided with a plurality of levels (for example, two levels) of the feeding cassettes 15 at a lower portion of the device main body 12. The plurality of levels of the feeding cassettes 15 are disposed to be overlapped in the vertical direction Z. The plurality of feeding cassettes 15 are disposed to be insertable into and removable from the device body 12 in the X direction.

The feeding cassette 15 includes a handle 15A used when the user performs a pulling out operation. The user can insert the feeding cassette 15 into the device main body 12 by moving the feeding cassette 15 in the positive X direction, and can pull out the feeding cassette 15 from the device main body 12 by moving the feeding cassette 15 in the negative X direction. When the user replenishes the media M in the feeding cassette 15 or changes the type of the media M to be set in the feeding cassette 15, the user pulls out the feeding cassette 15 from the device main body 12 and replenishes or replaces (changes) the media M. The number of levels of the feeding cassette 15 is not limited to two, and may be one level, three levels, four levels, five levels, or the like. Further, some or all of the plurality of levels of the feeding cassettes 15 may be constituted by an additional installation unit that is installed as an option.

As illustrated in FIG. 1, the recording device 11 is provided with a first cover 16 and a second cover 17 on a side surface 12S of the device main body 12. When a jam occurs of the medium M transported from the feeding cassette 15, each of the covers 16 and 17 is opened and closed and used for resolving the jam. The first cover 16 is provided with an openable/closable feeding tray 18. The user can set the medium M on the feeding tray 18 by opening the feeding tray 18 using a handle 18A. That is, in the recording device 11, in addition to feeding the medium M from the feeding cassette 15, the medium M can be set on the feeding tray 18 and can be the recording target.

Further, as illustrated in FIG. 1, the recording device 11 is provided with a recording unit 40 disposed inside the device main body 12. The recording unit 40 performs recording on the medium M fed from the feeding cassette 15. Further, the recording unit 40 performs the recording on the medium M fed from the feeding tray 18. The recording unit 40 includes a recording head 41 that performs the recording by discharging ink onto the medium M. The Ink is supplied to the recording head 41 from an ink supply source 19 disposed inside the device main body 12. A window portion 12W through which the user can visually recognize a remaining amount of the ink supply source 19 is provided in a front surface portion of the device main body 12. Note that the ink supply source 19 is constituted, for example, by a plurality of ink tanks or a plurality of ink cartridges.

A concave space is formed between the device main body 12 and the scanner unit 20, and a discharge tray 45 is disposed at a bottom portion of the concave space. The recorded media M discharged from the printer unit 13 are stacked on the discharge tray 45.

Configuration of Printer Unit 13

Next, a configuration of the printer unit 13 will be described with reference to FIG. 2.

The recording device 11 is provided with the feeding cassette 15 that can be inserted into and removed from the device main body 12. The plurality of media M are accommodated in the feeding cassette 15. The recording device 11 is provided with a transport mechanism 30 that transports the medium M accommodated in the feeding cassette 15. The media M accommodated in the feeding cassette 15 are fed out one by one, by a feeding roller 31, onto a transport path T indicated by a dashed line in FIG. 2. The medium M fed by the feeding roller 31 from the feeding cassette 15 is transported along the transport path T by separation roller pairs 32 and transport rollers 33. A transport path T1 along which the media M are transported from an external device (not illustrated), such as a large-capacity stacker device, and a transport path T2 along which the media M are transported from the feeding tray 18 converge in the transport path T.

Further, a transport unit 34, a plurality of transport roller pairs 35 that transport the medium M, a plurality of flaps 36 that switch the path along which the medium M is transported, and a medium width sensor 47 that detects the width of the medium M are disposed in the transport path T. The transport unit 34 is disposed at a position facing the recording head 41. The transport unit 34 is provided, for example, with a pair of rollers 37 and a transport belt 34A wound around the outer periphery of the pair of rollers 37. The transport belt 34A supports a recording portion of the recording target medium M on which the recording is performed by the recording head 41. Note that, instead of the transport unit 34, a configuration may be adopted in which the recording portion of the medium M is supported by a support table, such as a platen or the like.

The transport path T is curved in a region facing the medium width sensor 47, and extends obliquely upward from the medium width sensor 47. A transport path T3 and a transport path T4 toward the discharge tray 45, and an inversion path T5 for inverting the front and back of the medium M are provided downstream of the transport unit 34 in the transport path T. The transport mechanism 30 is provided with a discharge roller pair 38 that discharge the medium M from the transport path T3 and a discharge roller pair 39 that discharge the medium M from the transport path T4. The printed media M discharged from the transport path T3 by the discharge roller pair 38 are stacked on the discharge tray 45. In this way, the transport mechanism 30 is constituted by the feeding roller 31, the separation roller pairs 32, the transport rollers 33, the transport unit 34, the transport roller pairs 35, the flaps 36, the discharge roller pair 38, the discharge roller pair 39, and the like.

As illustrated in FIG. 2, in addition to the ink supply source 19 and the recording unit 40 described above, inside the device main body 12, the recording device 11 is provided with a control unit 100 that controls the entire device. The control unit 100 controls the printer unit 13 and the scanner unit 20. The control unit 100 controls the transport mechanism 30, the recording unit 40, the ink supply system, the display system, and the like that constitute the printer unit 13.

The recording unit 40 may be configured to be movable toward and away from the transport unit 34. When the recording is performed on the medium M, the recording unit 40 is disposed at a recording position illustrated in FIG. 2. When the recording unit 40 is disposed at the recording position, the recording head 41 faces a recording location, which is a position partway along the transport path T and is a position at which the recording is performed on the medium M.

The medium width sensor 47 is provided at a position upstream of the recording location on the transport path T. The control unit 100 controls a recording range or the like in the width direction X in which the recording unit 40 performs the recording on the medium M in accordance with the width of the medium M detected by the medium width sensor 47. The recording head 41 of the present example is an ink-jet recording type. The recording head 41 includes nozzles (not illustrated) capable of discharging the ink. The recording head 41 discharges the ink, which is supplied from the ink supply source 19 through a tube (not illustrated), toward the medium M from the nozzles. It should be noted that the recording head 41 is not limited to the ink-jet recording type that discharges the ink.

Further, the recording unit 40 of the embodiment adopts a line recording method. The recording head 41 is a line head capable of line recording. The recording head 41 is a long line head that is long in the width direction X of the medium M. A plurality of nozzles (not illustrated) are arrayed at a predetermined nozzle pitch over a range wider than the width of the medium M having the maximum width. The recording head 41 discharges the ink from the nozzles onto the medium M transported at a constant speed by the transport belt 34A of the transport unit 34, and thus prints the characters, the image, or the like on the medium M. Note that the recording unit 40 may be a serial recording type. In this case, the recording unit 40 is provided with a carriage (not illustrated) that is movable in the width direction X, and performs the recording on the medium M by discharging the ink from the nozzles in the course of the recording head 41 moving in the width direction X together with the carriage. In the case of the serial recording method, the medium M is intermittently transported, and the recording by the recording head 41 and the transport of the medium M are alternately performed, so that the characters or the image are recorded on the medium M.

The control unit 100 is configured to include a central processing unit (CPU), a read only memory (ROM), a random access memory (RAM), and a storage (all not illustrated). The control unit 100 controls the transport of the medium M by the transport mechanism 30 and the recording operation on the medium M by the recording unit 40, in the recording device 11. Further, the control unit 100 controls the transport of the document D and the reading operation of the document D by the scanner unit 20. The control unit 100 is not limited to a control unit that performs software processing for all the processing performed by the control unit 100. For example, the control unit 100 may be configured to include a dedicated hardware circuit (an application specific integrated circuit (ASIC), for example) that performs hardware processing for at least some of the processing performed by the control unit 100. In other words, the control unit 100 may be configured as circuits (circuitry) including one or more processors that operate in accordance with a computer program (software), one or more dedicated hardware circuits that perform at least some of the various processing, or a combination of these. Along with a CPU, the processor includes a memory, such as a RAM, a ROM, and the like, which stores a program code or instructions configured to cause the CPU to perform the processing. The memory, that is, a computer-readable medium, includes any available medium that can be accessed by a general purpose or a dedicated computer.

Configuration of Feeding Cassette 15

Figure 3:
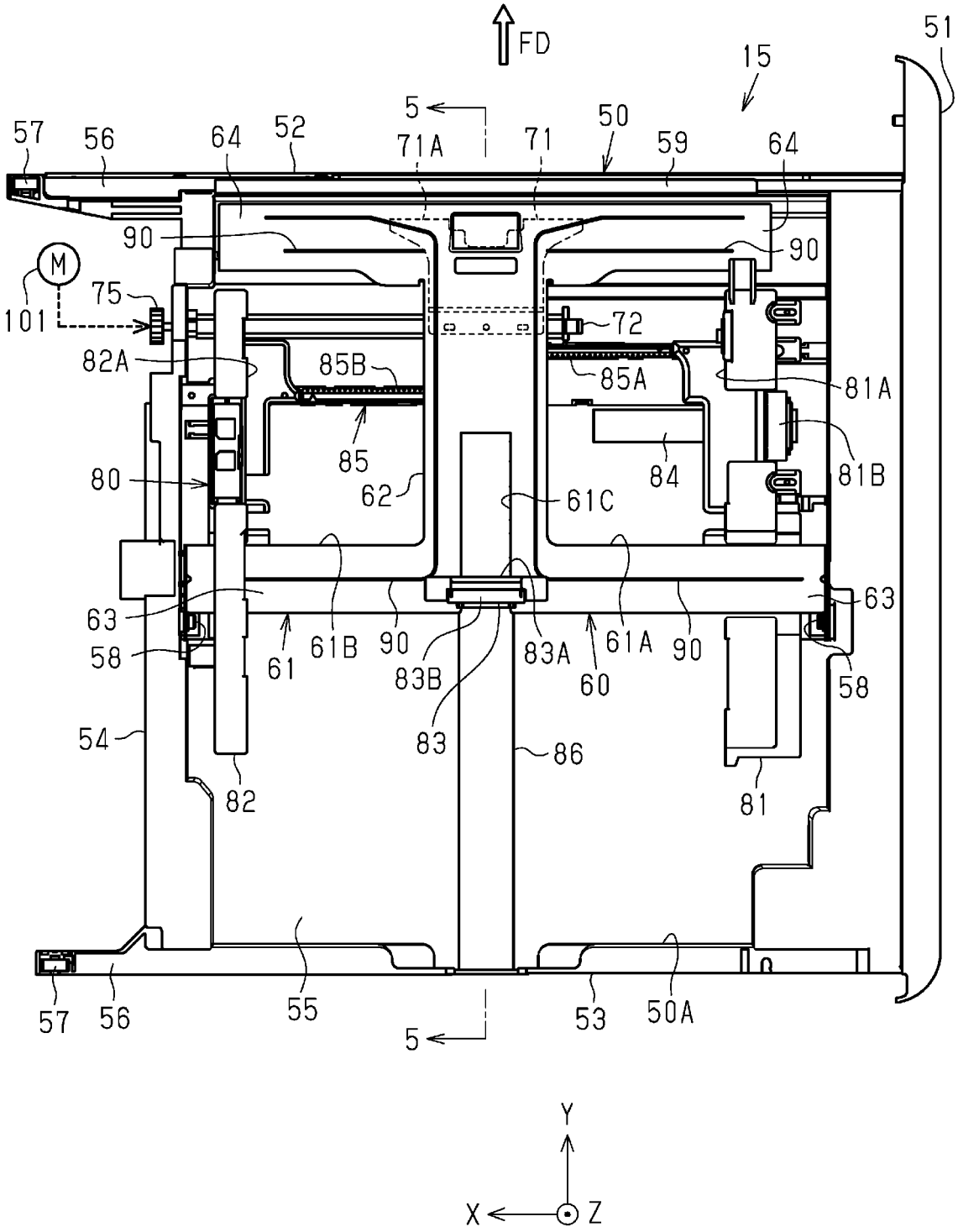
FIG. 3 is a schematic perspective view illustrating a feeding cassette.

Next, a configuration of the feeding cassette 15 will be described in detail with reference to FIG. 3. As illustrated in FIG. 3, the feeding cassette 15 is provided with a cassette body 50, a hopper mechanism 60, and a medium positioning mechanism 80. The hopper mechanism 60 and the medium positioning mechanism 80 are assembled inside the cassette body 50.

The cassette body 50 is configured to be able to accommodate the media M in the stacked state. The hopper mechanism 60 moves the media bundle MB accommodated in the cassette body 50 to the feeding position where an uppermost medium M1 comes into contact with the feeding roller 31 (refer to FIG. 2 and FIG. 5). The hopper mechanism 60 is provided with a hopper 61 which is disposed in the cassette body 50 and on which the media M are stacked, and a lift plate 71 which supports the under surface of the hopper 61 from below and moves the hopper 61 upward. The hopper 61 is configured to be swingable with respect to the cassette body 50. The lift plate 71 is supported to be rotatable about a rotational movement shaft 72 parallel to the width direction X with one end portion thereof in the longitudinal direction (the feeding direction FD) serving as a rotational fulcrum, and supports the hopper 61 at a tip portion 71A that is the end portion on the opposite side to the rotational fulcrum.

The hopper 61 includes a central portion 62 located at the center in the width direction X, and extension portions 64 extending to both sides in the width direction X from a downstream portion of the central portion 62 in the feeding direction FD in which the medium M is transported. The hopper 61 may include base portions 63 extending to both sides in the width direction X from an upstream portion of the central portion 62 in the feeding direction FD. The hopper 61 is rotatable about a rotational fulcrum on the base 63 side.

Further, the medium positioning mechanism 80 is operated by the user so as to be able to position the media bundle MB accommodated in the cassette body 50. The medium positioning mechanism 80 is provided with side guides 81 and 82 that regulate the position of the medium M in the width direction X and are configured to be movable in the width direction X. Further, the medium positioning mechanism 80 may include a rear guide 83 that regulates the position of the medium M in the feeding direction FD and is configured to be movable in the feeding direction FD.

Hereinafter, the configuration of each of the cassette body 50, the hopper mechanism 60, and the medium positioning mechanism 80 will be described in detail.

Configuration of Cassette Body 50

First, the configuration of the cassette body 50 will be described with reference to FIG. 3. The cassette body 50 is a rectangular box-shaped housing case that is open upward. The cassette body 50 includes an accommodating recess 50A that can accommodate the media M. The cassette body 50 includes a plate-shaped cover portion 51 constituting a front portion thereof, a pair of left and right side walls 52 and 53, a rear wall 54 extending in parallel to the cover portion 51, and a substantially rectangular plate-shaped bottom portion 55 forming a bottom surface of the accommodating recess 50A. The cassette body 50 is provided with a pair of extension portions 56 extending further inward from the rear wall 54, and a pair of rollers 57 rotatably provided at tip portions of the pair of extension portions 56. The pair of rollers 57 roll along a rail (not illustrated) inside the device main body 12, so that the feeding cassette 15 can be inserted into and removed from the device main body 12 with a light operation force.

Configuration of Medium Positioning Mechanism 80

Next, the configuration of the medium positioning mechanism 80 will be described with reference to FIG. 3. As illustrated in FIG. 3, the pair of side guides 81 and 82 constituting the medium positioning mechanism 80 are provided at the accommodating recess 50A of the cassette body 50 so as to be slidable in the width direction X. The pair of side guides 81 and 82 are assembled so as to be movable in the width direction X along the guide portion 84 or the like provided at the bottom portion 55 of the cassette body 50. The pair of side guides 81 and 82 can move toward and away from each other by the same amount in the width direction X. The pair of side guides 81 and 82 include a pair of guide surfaces 81A and 82A that guide the side edges of the medium M on both sides in the width direction. The side guide 81 includes an operation portion 81B that can be locked and unlocked by the user. When the user operates the operation portion 81B and moves the one side guide 81 in an unlocked state, the pair of side guides 81 and 82 move in conjunction with each other, and the position of the media bundle MB in the width direction X is determined. When the user stops the operation of the operation portion 81B after the position is determined, the pair of side guides 81 and 82 are locked at that position.

As illustrated in FIG. 3, the medium positioning mechanism 80 is provided with a rack and pinion mechanism 85 that slides the pair of side guides 81 and 82 in conjunction with each other. The rack and pinion mechanism 85 includes a first rack 85A, a second rack 85B, and a pinion (not illustrated).

The first rack 85A is fixed to a bottom portion of the first side guide 81 and extends in the width direction X toward the second side guide 82. The second rack 85B is fixed to a bottom portion of the second side guide 82 and extends in the width direction X toward the first side guide 81. The first rack 85A and the second rack 85B have rows of teeth on edge portions facing each other. The pinion is located at the width center between the first side guide 81 and the second side guide 82 in the width direction X, and engages with the teeth of the first rack 85A and the teeth of the second rack 85B.

In the recording device 11 according to the embodiment, center feeding is performed in which the medium M is fed so that the width center of the medium M passes through the width center position of the feed path, regardless of the size of the medium M. Therefore, when the first side guide 81 is moved in the positive X direction, the second side guide 82 is moved in conjunction therewith in the negative X direction, via the rack and pinion mechanism 85. When the first side guide 81 is moved in the negative X direction, the second side guide 82 is moved in conjunction therewith in the positive X direction, via the rack and pinion mechanism 85. In other words, the medium M having any width dimension is positioned at the width center position by the pair of side guides 81 and 82, where the center feeding is possible in the width direction X in the feeding cassette 15.

Further, the rear guide 83 is assembled so as to be movable in the feeding out direction Y along a guide portion 86 provided at the bottom portion 55 of the cassette body 50. The rear guide 83 has a guide surface 83A that guides the upstream end (rear end) of the media M in the feeding out direction Y. The rear guide 83 includes an operation portion 83B that can be locked and unlocked by the user. The user operates the operation portion 83B to move the rear guide 83 in an unlocked state and thus determines the position of the medium M in the feeding out direction Y. When the user stops the operation of the operation portion 83B, the rear guide 83 is locked at that position.

Configuration of Hopper Mechanism 60

Next, a configuration of the hopper mechanism 60 will be described with reference to FIG. 3. As illustrated in FIG. 3, the hopper mechanism 60 is assembled in the accommodating recess 50A of the cassette body 50. The hopper mechanism 60 is provided with the hopper 61 on which the media M are placed in the stacked state, and with the lift plate 71 that pushes up the hopper 61 to a predetermined angle corresponding to the loading amount of the media M, and rotates the hopper 61 to the feeding position where the uppermost medium M1 is pressed against the feeding roller 31.

The hopper 61 is disposed at a position, of a stacking region of the media M in the accommodating recess 50A, that is further downstream in the feeding out direction Y. The hopper 61 includes recessed portions 61A and 61B that avoid a movement region of the pair of side guides 81 and 82 and a recessed portion 61C that avoids a movement region of the rear guide 83. In other words, the hopper 61 includes the first recessed portion 61A that avoids the movement region of the first side guide 81, the second recessed portion 61B that avoids the movement region of the second side guide 82, and the third recessed portion 61C that avoids the movement region of the rear guide 83.

One end portion (a base end portion) of the lift plate 71 in the longitudinal direction thereof is fixed to the rotational movement shaft 72. As a result of the rotational movement of the rotational movement shaft 72, the lift plate 71 lifts up the hopper 61, which is in a retracted posture of having fallen to a substantially horizontal posture, to the feeding position in which the uppermost medium M1 of the media bundle MB on the hopper 61 comes into contact with the feeding roller 31. Thus, the tip portion 71A of the lift plate 71 on the side opposite to that of the rotational movement shaft 72 engages with the under surface of the hopper 61 in a state of being movable in the feeding direction FD.

As illustrated in FIG. 3, the rotational movement shaft 72 extends in the width direction X in the cassette body 50, one end portion thereof protrudes to the outside of the cassette body 50, and a gear 75 is fixed to the protruding one end portion. The gear 75 can engage with a gear (not illustrated) constituting a power transmission mechanism provided at the device main body 12 side. In other words, when the feeding cassette 15 is inserted into the device main body 12, the gear 75 is engaged with the gear on the device main body 12 side, and when the feeding cassette 15 is removed from the device main body 12, the gear 75 and the gear on the device main body 12 side are disengaged. A motor 101, which is a driving source of the hopper mechanism 60, is provided at the device main body 12. The rotational movement shaft 72 is rotated by power transmitted from the motor 101 via the power transmission mechanism and the gear 75. Note that, in the hopper mechanism 60, an elastic member (not illustrated) may be interposed between the lift plate 71 and the hopper 61. The elastic member may be a spring, or the like, for example. The elastic member may be biased in a direction of returning the hopper 61 at the feeding position to the retracted position.

As illustrated in FIG. 3, in a state where the feeding cassette 15 is removed from the device main body 12, the hopper 61 is disposed in the horizontal retracted posture in which the media bundle MB (see FIG. 2) is horizontally stacked thereon. When the feeding cassette 15 is inserted into the device main body 12, the insertion is detected by a sensor (not illustrated). When the control unit 100 detects the insertion of the feeding cassette 15 based on a detection signal of the sensor, the control unit 100 drives the motor 101 in a normal rotation direction. In this way, the lift plate 71 is rotated in the counterclockwise direction in FIG. 5 by the rotational movement of the rotational movement shaft 72. The hopper 61 supported from below by the tip portion 71A of the lift plate 71 is rotated from the retracted position to a feeding position P1 illustrated in FIG. 5, by the rotational movement of the lift plate 71. At the feeding position P1, the uppermost medium M1 of the media bundle MB on the hopper 61 comes into contact with the feeding roller 31.

Figure 5:
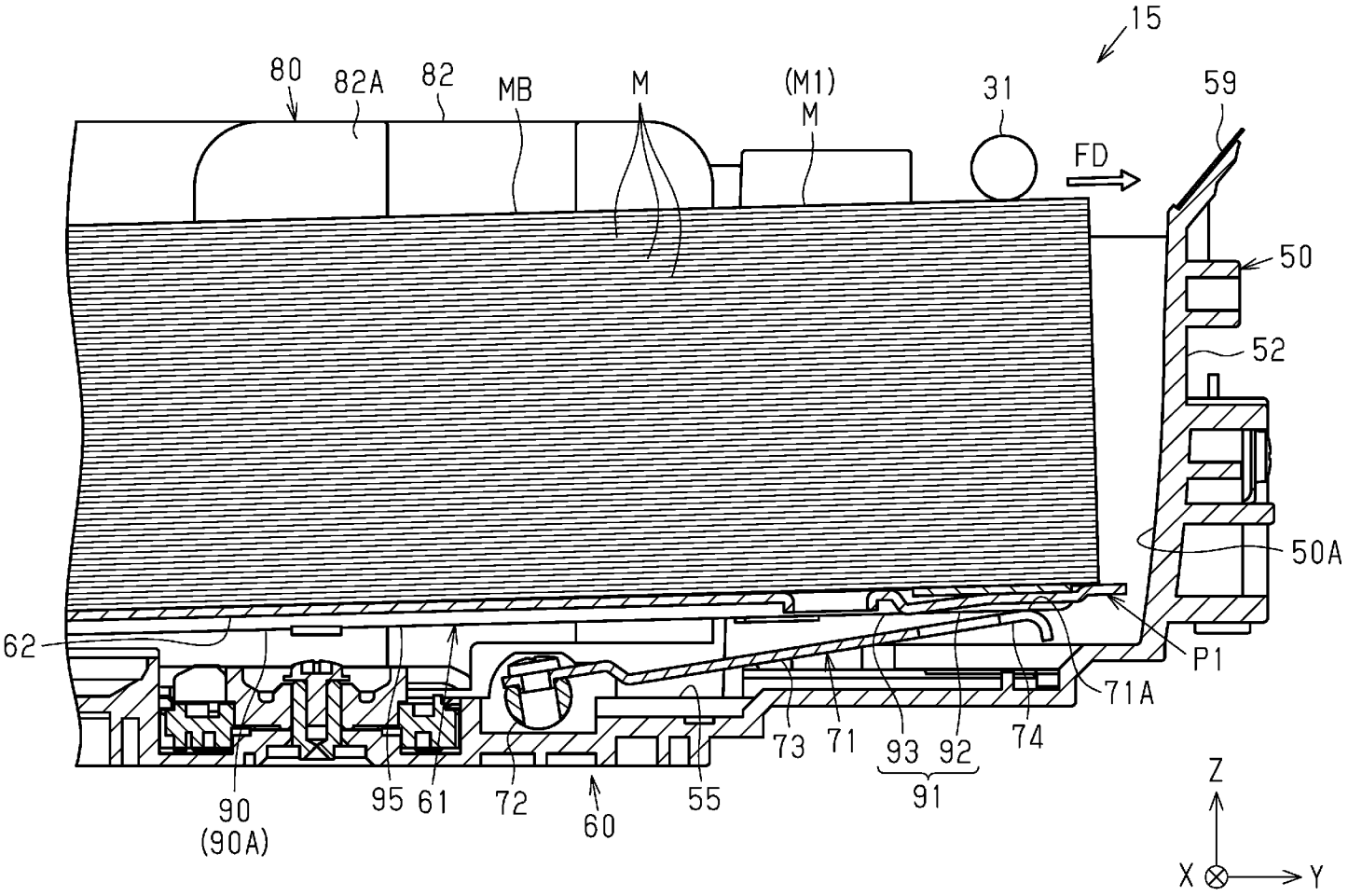
FIG. 5 is a partial side cross-sectional view illustrating the feeding cassette when the hopper is at the first feeding position.
Figure 7:
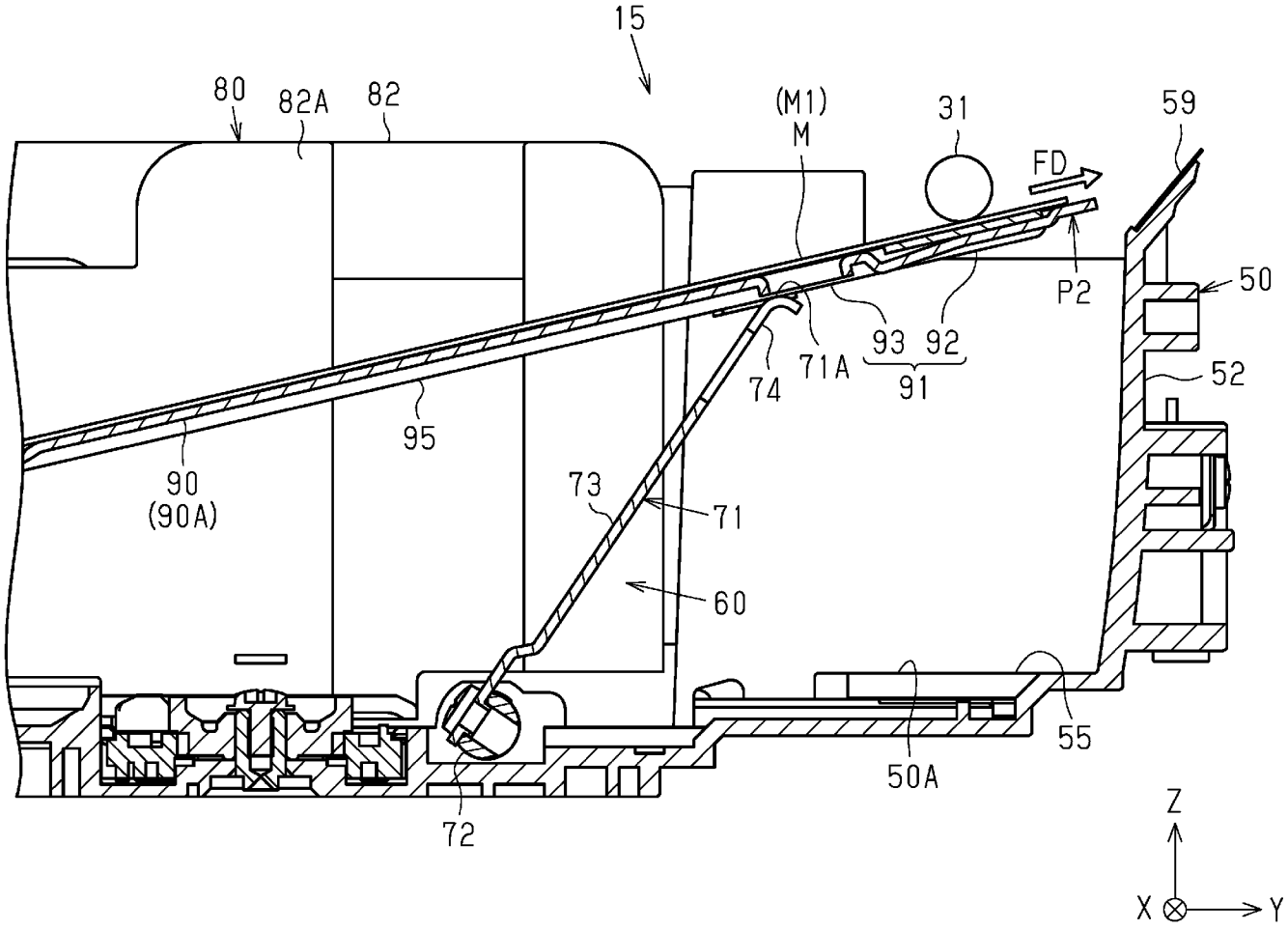
FIG. 7 is a partial side cross-sectional side view illustrating the feeding cassette when the hopper is at the second feeding position.

When a maximum loading amount of the media bundle MB is stacked on the hopper 61, the hopper 61 rotates to the lowest feeding position P1 illustrated in FIG. 5. On the other hand, when only one sheet of the medium M, which is a minimum loading amount, is stacked on the hopper 61, the hopper 61 rotates to a highest feeding position P2 illustrated in FIG. 7. As described above, the hopper 61 rotates within a predetermined angle range including the retracted position (FIG. 3), the lowest feeding position P1 (FIG. 5), and the highest feeding position P2 (FIG. 7). When the hopper 61 rotates over the predetermined angle range, an engagement position at which the tip portion 71A of the lift plate 71 engages with the under surface of the hopper 61 changes in the feeding direction FD.

As illustrated in FIG. 5 and FIG. 7, an inclined separation plate 59 is attached to an upper end portion of the side wall 52, which is positioned downstream in the feeding direction FD in the cassette body 50. The separation plate 59 is inclined so as to become higher the further downstream in the feeding direction FD. When the feeding roller 31 rotates in a state where the hopper 61 is at the feeding position, the uppermost medium M1 is fed out in the feeding direction FD. Height positions of the feeding roller 31 and the separation plate 59 are set such that a leading end portion in the feeding direction FD of the fed out medium M1 comes into contact with the separation plate 59. For example, when the media M fed out by the feeding roller 31 are doubly fed, the medium M on the lower side that has been doubly fed receives a large friction force from the separation plate 59 and is thereby separated from the uppermost medium M1. That is, even when the media M are doubly fed, only the single sheet of the uppermost medium M1 is separated and fed out.

Configuration of Hopper 61

The hopper mechanism 60 illustrated in FIG. 3 illustrates a state in which the hopper 61 on which the maximum loading amount of the medium M are stacked is at the feeding position. The hopper 61 including the concave portions 61A and 61B has, for example, a sideways H shape in plan view in FIG. 3.

The H-shaped hopper 61 includes the central portion 62 extending along the feeding out direction Y, the pair of base portions 63 extending to both sides in the width direction X from the upstream end portion of the central portion 62 in the feeding direction FD, and the pair of extension portions 64 extending to both sides in the width direction X from the downstream end portion of the central portion 62 in the feeding direction FD.

The central portion 62 is positioned so as to extend in the feeding direction FD at the width center between the pair of side guides 81 and 82. A pair of pin portions 58 protruding inward in the width direction X from a set of inner wall surfaces facing each other in the width direction X of the cassette body 50 are inserted into holes (not illustrated) of a pair of plate portions extending from both end portions in the width direction X of the pair of base portions 63. The hopper 61 is supported by the cassette body 50 so as to be rotatable about a rotational movement shaft parallel to the width direction X, with the pair of pin portions 58 supporting the upstream end portion of the hopper 61 in the feeding direction FD serving as a rotational fulcrum.

Here, the pair of recessed portions 61A and 61B on both sides in the width direction X of the substantially H-shaped hopper 61 are provided to secure the movement regions of the pair of side guides 81 and 82. In other words, the pair of recessed portions 61A and 61B are provided of a size to avoid interference between the hopper 61 and the pair of side guides 81 and 82, so that the pair of side guides 81 and 82 can determine the position of the media M in the width direction X, from the maximum width to the minimum width. When a configuration is to be adopted in which the minimum width dimension of the medium M that can be set in the feeding cassette 15 is set to be short, in order to also be able to perform the recording on the medium M having the short width dimension, it is necessary to adopt a configuration in which the pair of side guides 81 and 82 are able to move closer together to a shorter interval.

In order to achieve this, it is necessary to increase the depth dimension, in the width direction X, of the pair of recessed portions 61A and 61B that are provided to avoid the interference with the pair of side guides 81 and 82. In the embodiment, since the minimum width of the media M that can be set in the feeding cassette 15 is set to be short, the depth dimension of the pair of recessed portions 61A and 61B in the width direction X is relatively long, and as a result, the width dimension of the central portion 62 is relatively short. In other words, the width of the central portion 62 is relatively narrow. The thinning of the central portion 62 leads to a decrease in rigidity of the central portion 62.

Further, in general, the medium M having the short minimum width also has a short dimension in the feeding direction FD. Therefore, the recessed portion 61C provided in the central portion 62 to avoid the interference between the rear guide 83 and the hopper 61 also has a relatively long depth dimension in the feeding direction FD. The increase in the depth dimension of the recessed portion 61C leads to a decrease in the rigidity of the central portion 62.

Using, as the rotational fulcrum, the pair of pin portions 58 at the positions in the vicinity of outer side end portions of the pair of base portions 63, the hopper 61 rotates so as to displace a T-shaped portion formed by the central portion 61 and the pair of extension portions 64 upward. In particular, when the large-sized media M are stacked on the hopper 61 to the maximum loading amount or a loading amount close to the maximum loading amount, there is a possibility that a downstream portion of the hopper 61 in the feeding direction FD may be deformed, such as being bent to the lower side in the vertical direction Z (downward), due to the weight of the media bundle MB. Since the downstream end portion of the central portion 62 is supported by the tip portion 71A of the lift plate 71 from the under surface thereof, the deformation, such as bending, is relatively unlikely to occur. However, portions, of the pair of extension portions 64, that are separated outward from the central portion 62 in the width direction X are not supported by the lift plate 71. For this reason, of the pair of extension portions 64, the further portions thereof are to the outside in the width direction X, the more likely the portions are to be deformed to the lower side in the vertical direction Z (downward), due to the weight of the media bundle MB.

Here, as a measure for suppressing such bending of the extension portions 64, it is conceivable to increase the width dimension of the entire lift plate 71 to increase a region in the width direction X that supports the pair of extension portions 64 from the under surface. However, the tip portion 71A of the lift plate 71 moves in the feeding direction FD in a state of being engaged with the under surface of the hopper 61. When a part of the lift plate 71 protrudes to the outer side from the central portion 62 in the width direction X, there is a possibility that the lift plate 71 may interfere with the pair of side guides 81 and 82. For this reason, when a measure is taken to make the overall width dimension of the lift plate 71 wider than the width dimension of the central portion 62, it is necessary to limit the range over which the tip portion 71A of the lift plate 71 can move in the feeding direction FD with respect to the under surface of the hopper 61 to be within a range of the extension portions 64. In this case, a rotatable range of the hopper 61 is limited to being small. On the other hand, if the range over which the tip portion 71A of the lift plate 71 can move in the feeding direction FD with respect to the under surface of the hopper 61 is set to exceed the range of the extension portions 64 in the feeding direction FD, the rotatable range of the hopper 61 can be secured to be wide. In this case, in order to avoid the interference between the lift plate 71 and the pair of side guides 81 and 82, the width dimension of the lift plate 71 needs to be equal to or less than the width dimension of the central portion 62. When the width dimension of the lift plate 71 is shorter, the range in the width direction X over which the tip portion 71A of the lift plate 71 can support the under surface of the hopper 61 becomes narrower, which results in the pair of extension portions 64 becoming more likely to bend.

Further, as long as the pair of side guides 81 and 82 can guide the media bundle MB as far as possible to a portion further downstream in the feeding direction FD, when the medium M positioned by the pair of side guides 81 and 82 is fed out, a positional displacement of the medium M in the width direction X is less likely to occur. In other words, as long as the pair of side guides 81 and 82 can guide the media bundle MB as far as possible to the portion further downstream in the feeding direction, transport displacement of the medium M is suppressed, and a high transport accuracy of the medium M is secured. In order to secure such transport accuracy, the downstream end portions of the pair of side guides 81 and 82 may be disposed at positions relatively further downstream in the feeding direction FD with respect to the hopper 61. In this case, the dimension of the pair of extension portions 64 in the feeding direction FD is relatively short. That is, since the extension portions 64 are relatively thin, this leads to a reduction in the rigidity of the extension portions 64.

As illustrated in FIG. 3, constricted portion for reinforcements 90 are formed in the substantially H-shaped hopper 61. The straight line constricted portion 90 that extends along a predetermined path is formed in the hopper 61 by performing a drawing operation on a substantially H-shaped metal plate member. The constricted portion 90 protrudes to the under surface side of the hopper 61. The hopper 61 is reinforced by the constricted portion 90. The constricted portions 90 are formed so as to draw paths that are line-symmetric with respect to the width center line of the hopper 61. The constricted portion 90 has a groove shape when viewed from a placement surface side on which the media M are placed (that is, in a plan view in FIG. 4), of the top and under surfaces of the hopper 61, and, when viewed from the under side that is the opposite surface, is a portion formed by the drawing operation to protrude in a convex shape to the under surface side. In the hopper 61, the constricted portion for reinforcement 90 is formed along the predetermined path over the central portion 62, the base portion 63, and the extension portion 64.

Figure 4:
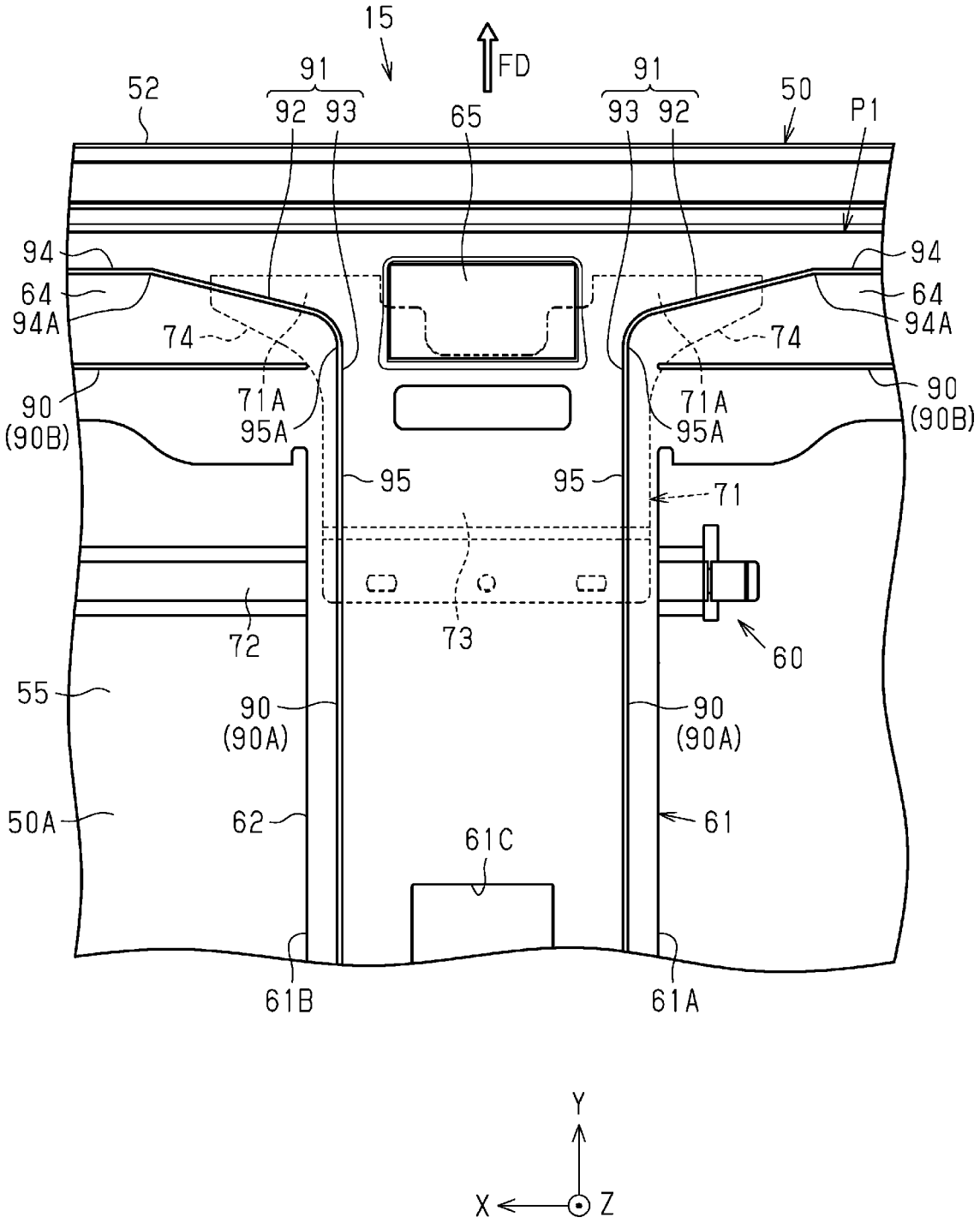
FIG. 4 is a partial plan view illustrating the feeding cassette when a hopper is at a first feeding position.

As illustrated in FIG. 4, a friction plate 65 is attached to a downstream end portion, in the feeding direction FD, of the central portion 62 of the hopper 61. The friction plate 65 has a function of assisting the feeding out of the medium M by the feeding roller 31, by applying a predetermined frictional resistance between the medium M and a stacking surface of the hopper 61 when the last one sheet of the medium M stacked on the hopper 61 is fed out.

The lift plate 71 includes an arm portion 73 that is a long rectangular plate-shaped portion including a base end portion of the lift plate 71, and a wide portion 74 that is formed to be wider at a portion closer to the tip end than the arm portion 73. Then, a portion of the wide portion 74 that engages with the under surface of the hopper 61 is the tip portion 71A. The wide portion 74 has a width dimension longer in the width direction X than the width dimension of the central portion 62 of the hopper 61. Both end portions of the wide portion 74 in the width direction X are positioned further outward than the central portion 62 of the hopper 61 in the width direction X, and can be engaged with the under surfaces of the pair of extension portions 64.

Configuration of Constricted Portion 90

Next, the configuration of the constricted portion 90 will be described with reference to FIG. 4.

As illustrated in FIG. 4, the hopper 61 includes the constricted portion for reinforcement 90 that protrudes to the under side. The constricted portion for reinforcement 90 is provided in at least the extension portion 64. In the example illustrated in FIG. 4, the constricted portion for reinforcement 90 is provided along the predetermined path extending over all of the central portion 62, the base portion 63, and the extension portion 64. For example, as illustrated in FIG. 4, as the constricted portion for reinforcement 90, the hopper 61 is provided with a constricted portion for reinforcement 90A provided over the extension portion 64, the central portion 62, and the base portion 63, and a constricted portion for reinforcement 90B provided in the extension portion 64.

The constricted portion for reinforcement 90 includes a supporting constricted portion 91 with which the tip portion 71A of the lift plate 71 comes into contact when supporting the under surface of the hopper 61 in a swingable range of the hopper 61. As a result of the tip portion 71A of the lift plate 71 sliding with respect to the under surface of the hopper 61 along the supporting constricted portion 91, a sliding resistance between the tip portion 71A and the under surface of the hopper 61 is suppressed. As a result, smooth rotation of the hopper 61 is realized without the tip portion 71A of the lift plate 71 being caught up on the under surface of the hopper 61.

When the hopper 61 rotates, the tip portion 71A of the lift plate 71 moves relatively in the feeding direction FD with respect to the under surface of the hopper 61. For that reason, the supporting constricted portion 91 along which the tip portion 71A of the lift plate 71 slides is provided in a path including a component in the feeding direction FD. The supporting constricted portion 91 includes a first constricted portion 92 provided in a path including a component in the feeding direction FD. At least a part of the first constricted portion 92 is provided in the extension portion 64. In the example illustrated in FIG. 4, a part of the first constricted portion 92 is formed in the extension portion 64, and a remaining part of the first constricted portion 92 is formed in the central portion 62. The first constricted portion 92 of the present example extends in a straight line in an oblique direction intersecting the feeding direction FD at a predetermined acute angle. In other words, the first constricted portion 92 of the present example is a constricted portion that extends along a path including components in both the width direction X and the feeding direction FD. In this way, the first constricted portion 92 is a constricted portion that extends in a straight line.

The lift plate 71 supports the first constricted portion 92 over at least a part of the swingable range of the hopper 61. Since a part of the first constricted portion 92 is formed in the extension portion 64, the tip portion 71A of the lift plate 71 can support the under surface of the hopper 61 even at the portion of the extension portion 64.

As illustrated in FIG. 4, when the hopper 61 is at the first feeding position P1 at which the hopper 61 is inclined at a minimum angle in the swingable range, the tip portion 71A of the lift plate 71 comes into contact with the first constricted portions 92 at positions outside the range of the central portion 62 in the width direction X. In other words, when the hopper 61 is at the first feeding position P1, the supporting constricted portions 91 come into contact with the tip portion 71A of the lift plate 71 at positions outside the range of the central portion 62 in the width direction X.

Furthermore, the supporting constricted portion 91 includes a longitudinal constricted portion 93 provided in the central portion 62 in a path including a component in the feeding direction FD. In other words, the supporting constricted portion 91 includes the first constricted portion 92 extending in a straight line in an oblique direction, and the longitudinal constricted portion 93, which is a part of a third constricted portion 95 that is joined to an upstream end of the first constricted portion 92 in the feeding direction FD and extends in the feeding direction FD in the central portion 62. Here, in plan view when viewing the feeding cassette 15 at an orientation in which the feeding direction FD is the longitudinal direction, the longitudinal constricted portion 93 extends in a straight line in the feeding direction FD (a longitudinal direction).

Figure 6:
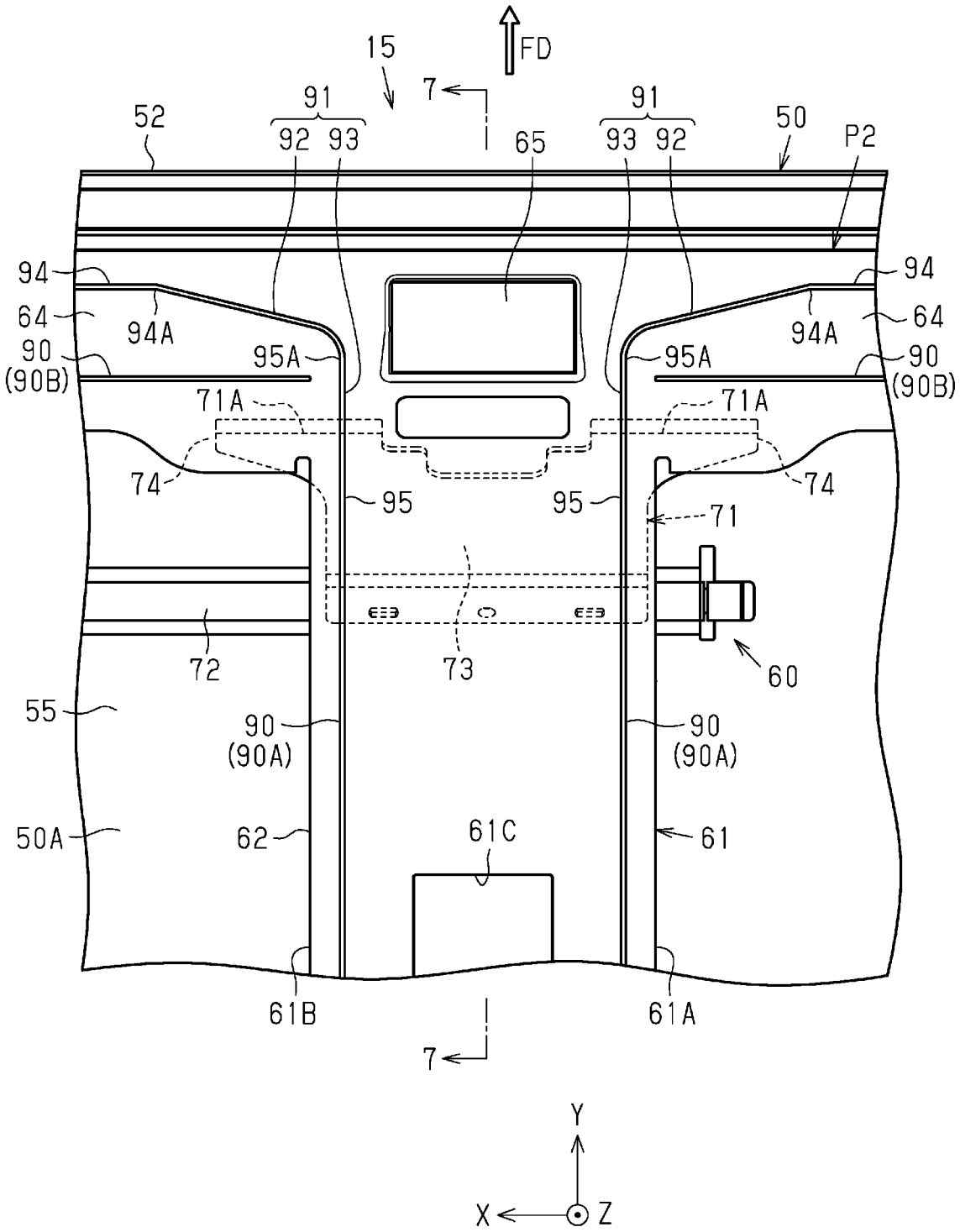
FIG. 6 is a partial plan view illustrating the feeding cassette when the hopper is at a second feeding position.

Further, as illustrated in FIG. 6, when the hopper 61 is at the second feeding position P2 at which the hopper 61 is inclined at a maximum angle, the tip portion 71A of the lift plate 71 comes into contact with the longitudinal constricted portions 93 at positions within the range of the central portion 62 in the width direction X. In other words, when the hopper 61 is at the second feeding position P2, the supporting constricted portions 91 come into contact with the tip portion 71A of the lift plate 71 at positions within the range of the central portion 62 in the width direction X.

As described above, the supporting constricted portions 91 are formed in the predetermined paths so as to be able to be in contact with the lift plate 71 at positions outside the range of the central portion 62 when the hopper 61 is at the first feeding position P1 and to be able to be in contact with the lift plate 71 at positions within the range of the central portion 62 in the width direction X when the hopper 61 is at the second feeding position P2.

As illustrated in FIG. 4 and FIG. 6, the constricted portion for reinforcement 90 includes a second constricted portion 94 that, in the extension portion 64, is joined to the first constricted portion 92 and extends in a path including a component in the width direction X. The hopper 61 includes, in the central portion 62, the third constricted portion 95 extending in the feeding direction FD as the constricted portion for reinforcement 90. The first constricted portion 92 is joined to the third constricted portion 95 extending in the central portion 62 of the hopper 61.

As illustrated in FIG. 4 and FIG. 6, in the feeding direction FD, the positions of inner ends 94A of the second constricted portions 94 are located downstream of the positions of downstream ends 95A of the third constricted portions 95. The first constricted portion 92 is a constricted portion that joins the inner end 94A of the second constricted portion 94 and the downstream end 95A of the third constricted portion 95.

As illustrated in FIG. 4, the pair of supporting constricted portions 91 are provided on both sides of the width center of the hopper 61, over a range including part of each of the first constricted portion 92 and the third constricted portion 95. An interval in the width direction X between the pair of constricted portions 91 supported by the lift plate 71 is widest when the hopper 61 is at the first feeding position P1 at the time of the maximum loading amount.

As illustrated in FIG. 4, the rotational movement shaft 72 of the lift plate 71 is disposed upstream of the extension portions 64 in the feeding direction FD. The lift plate 71 is covered by the hopper 61 when the lift plate 71 is at a maximum raised position and at a maximum lowered position. In the embodiment, the wider portion 74, which is a portion on the tip end side of the lift plate 71, is formed to be wider than the central portion 62. However, when the lift plate 71 rotates over the range between the maximum lowered position when the hopper 61 is located at the retracted position, and the maximum raised position when the hopper 61 is located at the second feeding position P2, the tip portion 71A moves in the feeding direction FD within the range of the extension portions 64 in plan view as illustrated in FIG. 4. In other words, the rotatable range between the retracted position and the second feeding position P2 of the hopper 61 is set such that the lift plate 71 is covered by the hopper 61 when the lift plate 71 is at the maximum raised position and at the maximum lowered position.

As illustrated in FIG. 4, the first constricted portions 92 are formed in the paths such that a second interval is narrower than a first interval, in the swingable range of the hopper 61. The second interval is an interval between second positions when the hopper 61 is supported at the second positions, the first interval is an interval between first positions, and the second positions are positions further upstream in the feeding direction FD than the first positions on the first constricted portions 92 when the hopper 61 is supported at the first positions on the first constricted portions 92. For this reason, in a section supported by the first constricted portions 92, the under surface of the hopper 61 can be supported by the lift plate 71 at two positions located at an increasingly wider interval in the width direction X the more the hopper 61 approaches the first feeding position P1.

Actions of Embodiment

Next, actions of the embodiment will be described.

When accommodating the media M in the feeding cassette 15, the user moves the side guides 81 and 82 in the width direction X to sandwich the media bundle MB in the width direction X, thus positioning the media bundle MB in the accommodating recess 50A in the width direction X. In a state in which the feeding cassette 15 is removed from the device main body 12, the hopper 61 is at the retracted position. When the hopper 61 is at the retracted position, the hopper 61 and the lift plate 71 are both in a substantially horizontal posture, and the hopper 61 overlaps the lift plate 71 above the lift plate 71. Then, the user inserts the feeding cassette 15 accommodating the media bundle MB into the device main body 12.

As illustrated in FIG. 5 and FIG. 7, when the user inserts the feeding cassette 15 into the device main body 12, the control unit 100 drives the motor 101 on the basis of the detection signal from the sensor (not illustrated) that detects the insertion of the feeding cassette 15. As a result, in a state in which the feeding cassette 15 is inserted into the device main body 12, the lift plate 71 rotates in the counterclockwise direction in FIG. 5, thus pushing up the hopper 61 from the retracted position at which the hopper 61 is in the substantially horizontal posture. The hopper 61 is disposed at the feeding position illustrated in FIG. 5 or FIG. 7, which is the inclined posture in which the downstream end of the hopper 61 in the feeding direction FD is raised. That is, the hopper 61 is pushed up to the feeding position at which the uppermost medium M1 of the media bundle MB stacked on the hopper 61 comes into contact with the feeding roller 31.

As illustrated in FIG. 5, when the media bundle MB stacked on the hopper 61 is the maximum loading amount, the lift plate 71 rotates in the counterclockwise direction from the maximum lowered position to the angle illustrated in FIG. 5, and the hopper 61 is thus disposed at the first feeding position P1 illustrated in FIG. 5. As described above, when the hopper 61 is at the maximum loading amount or at a loading amount close to the maximum loading amount, as illustrated in FIG. 4, the tip portion 71A of the lift plate 71 supports the under surface of the hopper 61 using the first constricted portions 92. In other words, the tip portion 71A of the lift plate 71 supports the under surface of the hopper 61 using the extension portions 64 positioned outside the central portion 62 in the width direction X. Thus, for example, even when the medium M having a large size in the width direction X is stacked on the hopper 61 at the maximum loading amount or a loading amount close to the maximum loading amount and the stacking weight is relatively large, a downward bending amount of the extension portions 64 of the hopper 61 can be suppressed to be relatively small. For this reason, a feeding error that may occur when the medium M fed by the feeding roller 31 comes into contact with the inner wall surface of the cassette body 50 due to the bending of the extension portions 64 is effectively reduced.

As illustrated in FIG. 5, when the feeding roller 31 rotates, the media bundle MB in the feeding cassette 15 is fed one by one from the uppermost medium M1. The fed medium M is transported along the transport path T, and the characters or image are recorded by the recording head 41 at the recording position partway along the transport path T. The medium M after the recording is discharged onto the discharge tray 45.

In this way, as the recording proceeds in the recording device 11, the number of the media M in the feeding cassette 15 decreases by one each time the medium M is fed. The hopper 61 and the lift plate 71 rotate in the counterclockwise direction in FIG. 5 so as to maintain a state in which the uppermost medium M1 is in contact with the feeding roller 31 as the loading amount of the media bundle MB decreases. In other words, the hopper 61 and the lift plate 71 rotate from the first feeding position P1 illustrated in FIG. 5 toward the second feeding position P2 illustrated in FIG. 7. In this rotation process, the position at which the tip portion 71A of the lift plate 71 is engaged with the under surface of the hopper 61 moves to the upstream side in the feeding direction FD, along the under surface of the hopper 61.

In other words, as illustrated in FIG. 4, the location at which the tip portion 71A of the lift plate 71 supports the first constricted portions 92 moves toward the upstream side in the feeding direction FD and toward the inner side in the width direction X, along the straight line paths of the first constricted portions 92. As a result, in the section where the lift plate 71 supports the first constricted portions 92, the location at which the tip portion 71A of the lift plate 71 supports the under surface of the hopper 61 moves inward in the width direction X as the loading amount of the media bundle MB on the hopper 61 decreases.

Then, when the lift plate 71 moves to a section supporting the longitudinal constricted portions 93 of the supporting constricted portions 91, the tip portion 71A of the lift plate 71 supports the hopper 61 within the range of the central portion 62 in the width direction X. In this section, since the loading amount of the medium M on the hopper 61 has become less than a predetermined threshold value, the medium stacking weight of the hopper 61 is relatively small. Thus, even when the tip portion 71A of the lift plate 71 supports the central portion 62 via the pair of longitudinal constricted portions 93, the bending amount of the pair of extension portions 64 is suppressed to be small.

Thus, the pair of extension portions 64 constituting the hopper 61 are less likely to be bent, regardless of the medium loading amount on the hopper 61. As a result, it is possible to suppress the occurrence of a feeding error that may occur due to the pair of extension portions 64 being bent downward by the weight of the media bundle MB stacked on the hopper 61.

Further, the supporting constricted portion 91 is joined to the second constricted portion 94 and the third constricted portion 95 to form the single constricted portion 90B. Thus, for example, the hopper 61 can be reinforced more strongly than in a configuration in which the constricted portion for reinforcement 90 is divided into a plurality of portions.

When the feeding cassette 15 is pulled out from the device main body 12, the engagement between the gear 75 and the gear on the device main body 12 side is released, so that the hopper 61 and the lift plate 71 fall almost freely. That is, the hopper 61 and the lift plate 71 return from the feeding position to the retracted position under their own weight. Note that, at this time, when the configuration includes the elastic member, the urging force of the elastic member acts as a part of the force for causing the hopper 61 and the lift plate 71 to fall to the retracted position.

Effects of Embodiment

Effects of the embodiment will be described.

(1) The feeding cassette 15 is provided with the cassette body 50, the hopper 61, the side guides 81 and 82, and the lift plate 71. The cassette body 50 is configured to be able to accommodate the media M in the stacked state. The hopper 61 is disposed in the cassette body 50 and the media M are stacked thereon. The hopper 61 is configured to be swingable with respect to the cassette body 50. The side guides 81 and 82 are configured to regulate the position of the medium M in the width direction X and to be movable in the width direction X. The lift plate 71 rotates around the rotational movement shaft parallel to the width direction X, with one end portion of the lift plate 71 serving as the rotational fulcrum. The lift plate 71 supports the under surface of the hopper 61 from below using the tip portion 71A, which is the end portion opposite to the rotational fulcrum, and moves the hopper 61 upward. The hopper 61 includes the central portion 62 located at the center in the width direction X, and the extension portions 64 extending to both sides in the width direction X from a downstream portion of the central portion 62 in the feeding direction FD in which the medium M is transported. The hopper 61 includes the constricted portion for reinforcements 90, which project to the under side, in at least the extension portions 64. The constricted portion for reinforcement 90 includes the supporting constricted portion 91 with which the tip portion 71A of the lift plate 71 comes into contact when supporting the under surface of the hopper 61 in the swingable range of the hopper 61. The supporting constricted portion 91 includes the first constricted portion 92, at least a part of which is provided in the extension portion 64 in the path having a component in the feeding direction FD. The lift plate 71 supports the first constricted portions 92 over at least a part of the swingable range of the hopper 61.

According to this configuration, firstly, since the extension portion 64 of the hopper 61 is provided with the constricted portion for reinforcement 90, the rigidity of the extension portion 64 can be increased. Secondly, since the first constricted portion 92 is the path including a component in the feeding direction FD, the lift plate 71 can support the extension portion 64 via at least a part of the first constricted portion 92 provided in the extension portion 64, within the range in which the support position of the hopper 61 by the lift plate 71 changes in the feeding direction FD between the raised position and the lowered position. Accordingly, compared to a case in which the lift plate 71 supports only the central portion 62 of the hopper 61, it is possible to suppress the extension portion 64 of the hopper 61 from being bent downward. Thus, a feeding failure of the medium M can be suppressed.

(2) The constricted portion for reinforcement 90 includes the second constricted portion 94 that is joined to the first constricted portion 92 and extends along the path including a component in the width direction X, in the extension portion 64. According to this configuration, since the second constricted portion 94 is provided as the constricted portion for reinforcement 90, the rigidity of the extension portion 64 of the hopper 61 can be further increased.

(3) The hopper 61 includes the third constricted portion 95 extending in the feeding direction FD as the constricted portion for reinforcement 90, in the central portion 62. According to this configuration, the rigidity of the central portion 62 of the hopper 61 can be increased by providing the third constricted portion 95. As a result, deformation of the hopper 61 in the feeding direction FD can be suppressed.

(4) The first constricted portion 92 is joined to the third constricted portion 95 that extends from the central portion 62 of the hopper 61. According to this configuration, since the two or more constricted portions are joined to each other to form the single constricted portion, the rigidity of the periphery of the hopper 61 where the constricted portions are formed can be increased.

(5) In the feeding direction FD, the position of the inner end 94A of the second constricted portion 94 is located downstream of the position of the downstream end 95A of the third constricted portion 95. The first constricted portion 92 is the constricted portion that joins the inner end 94A of the second constricted portion 94 and the downstream end 95A of the third constricted portion 95. According to this configuration, the three constricted portions 92, 94, and 95 (93) are joined together to constitute the single constricted portion, and can thus be disposed in a small space. For example, since the drawing process is easy, it is possible to reduce the product cost by reducing the processing cost.

(6) The first constricted portion 92 is the constricted portion that extends in the straight line. According to this configuration, as the medium loading amount of the hopper 61 increases, the lift plate 71 can support the extension portions 64 at the two points with the increasingly wider interval therebetween. Thus, it is possible to effectively suppress the bending of the extension portion 64 due to the weight of the medium.

(7) The supporting constricted portions 91 are provided as the pair on both sides of the width center of the hopper 61, over a range including part of each of the first constricted portion 92 and the third constricted portion 95. The interval in the width direction X between the pair of constricted portions supported by the lift plate 71 is widest when the hopper 61 is at the first feeding position P1 at the time of the maximum loading amount. According to this configuration, the lift plate 71 can support the pair of first constricted portions 92 with the widest gap therebetween in the width direction X at the time of the maximum loading amount on the hopper 61. Thus, even when the total weight of the stacked media M is large when the hopper 61 has the maximum loading amount or a large loading amount close to the maximum loading amount, the bending of the extension portion 64 can be effectively suppressed. On the other hand, thereafter, in the process in which the lift plate 71 moves to the highest position, the number of media M stacked on the hopper 61 decreases. For this reason, even when the support position of the lift plate 71 switches to the third constricted portion 95 in the central portion 62, since the total weight of the stacked media M is small, it is possible to suppress the deformation, such as the bending, of the extension portion 64 of the hopper 61.

(8) The rotational movement shaft of the lift plate 71 is disposed upstream of the extension portion 64 in the feeding direction FD. In plan view when the hopper 61 is viewed from a direction perpendicular to the stacking surface when the hopper 61 is at the retracted position of being lowered to a greatest extent, the lift plate 71 is covered by the hopper 61 when the lift plate 71 is at the maximum raised position and at the maximum lowered position. According to this configuration, the side guides 81 and 82 can be disposed close to the extension portions 64 and the central portion 62 of the hopper 61. That is, since the side guides 81 and 82 can be disposed more downstream in the feeding direction FD, it is possible to suppress the medium M from being fed in a skewed manner.

(9) The recording device 11 is provided with the feeding cassette 15 and the recording unit 40 that performs the recording on the medium M fed from the feeding cassette 15. According to this configuration, the same effects can be obtained in the recording device 11 as in the above-described feeding cassette 15.

Second Embodiment

Next, the feeding cassette 15 according to a second embodiment will be described with reference to FIG. 8 and FIG. 9. In the first embodiment, the first constricted portion 92 is the inclined constricted portion that extends in the straight line in the direction inclined at the acute angle with respect to the feeding direction FD, but the first constricted portion 92 is not limited to this configuration. A first constricted portion 96 may be a constricted portion extending in a curved shape, as in the second embodiment. Note that the configurations other than the configuration of the constricted portion 90, that is, the configurations of the recording device 11 and the feeding cassette 15 are the same as those of the first embodiment. Of the constricted portion 90, a configuration that differs from that of the first embodiment will be described below.

Configuration of Constricted Portion 90

Figure 8:
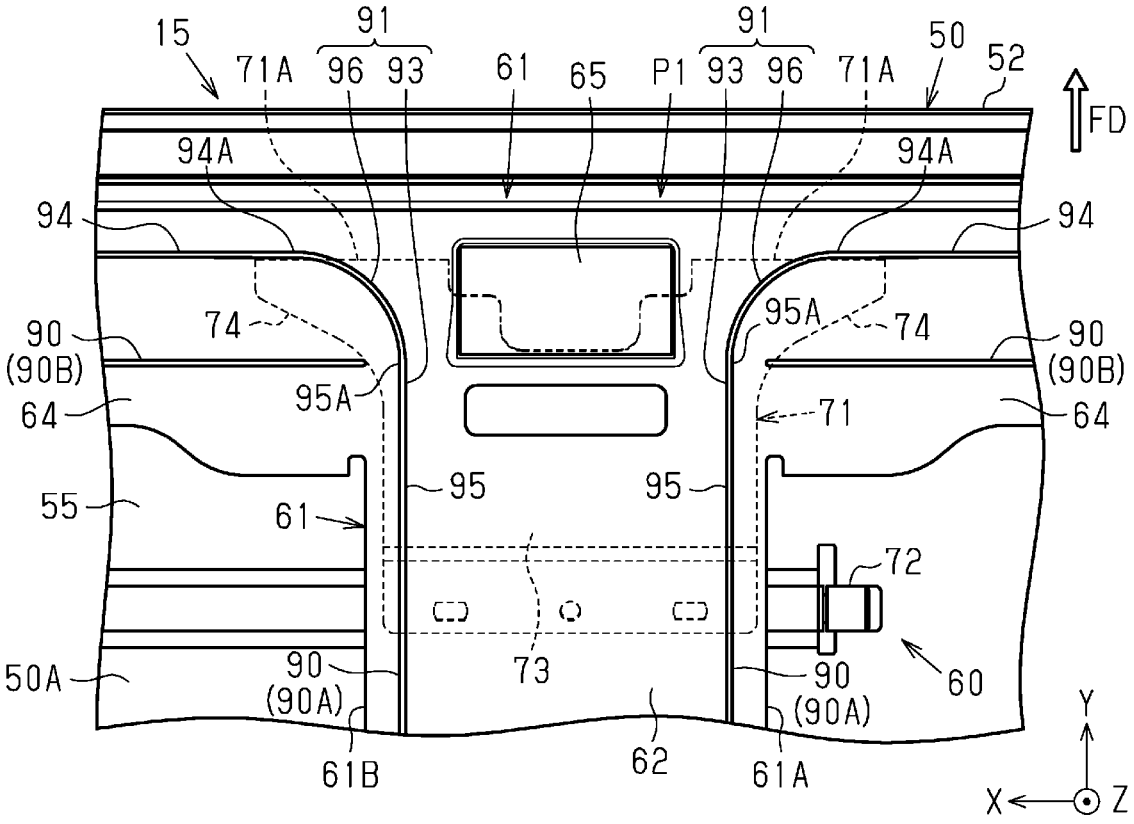
FIG. 8 is a partial plan view illustrating the feeding cassette when the hopper is at the first feeding position, in a second embodiment.
Figure 9:
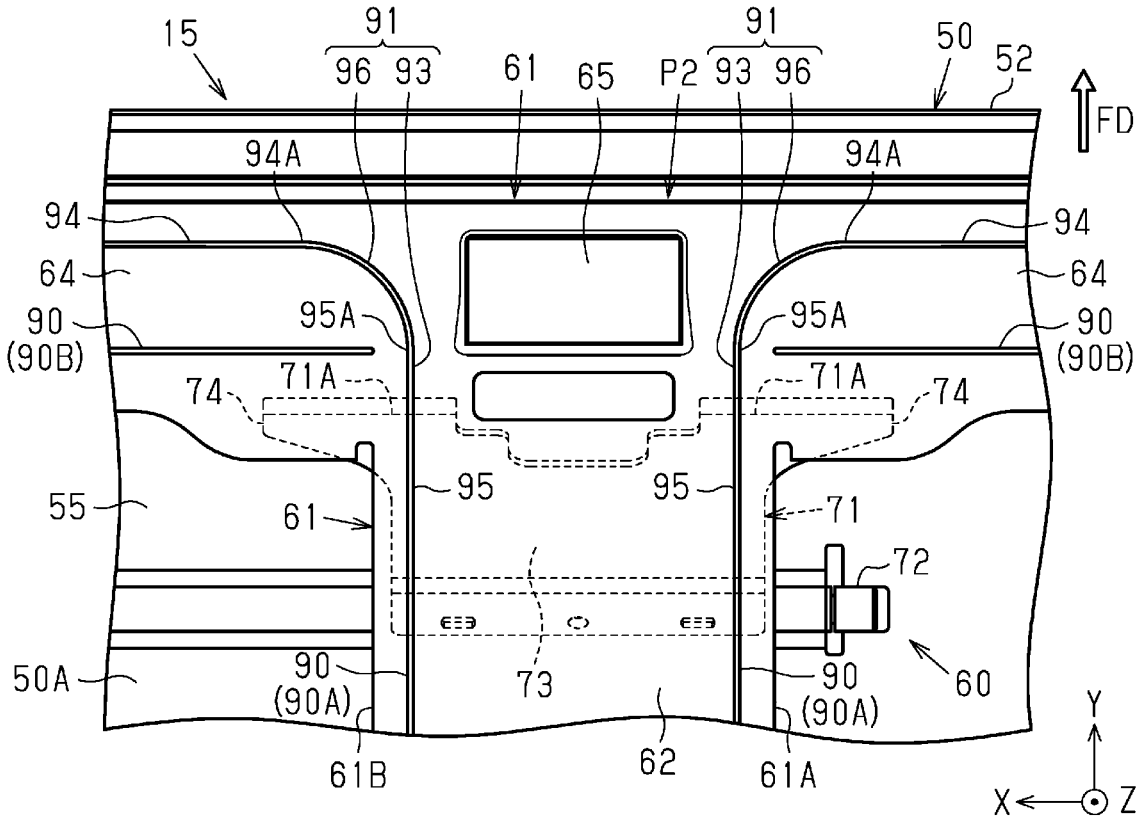
FIG. 9 is a partial plan view illustrating the feeding cassette when the hopper is at the second feeding position.

For example, as illustrated in FIG. 8 and FIG. 9, the supporting constricted portion 91 includes the first constricted portion 96 at least a part of which is provided in the extension portion 64 in a path including a component in the feeding direction FD, and the longitudinal constricted portion 93 which is a part of the third constricted portion 95. The first constricted portion 96 of the present example is constituted by a curved constricted portion. That is, as illustrated in FIG. 8, the first constricted portion 96 may be the constricted portion that extends in a curved shape. When the hopper 61 is at the first feeding position P1 at which the hopper 61 is inclined at the minimum angle in the swingable range, the hopper 61 comes into contact with the tip portion 71A of the lift plate 71 at positions outside the range of the central portion 62 in the width direction X. In other words, the lift plate 71 supports the first constricted portions 96 at the under surface of the extension portions 64, which are positions outside the range of the central portion 62 in the width direction X. Further, as illustrated in FIG. 9, when the hopper 61 is at the second feeding position P2 at which the hopper 61 is inclined at the maximum angle, the first constricted portions 96 come into contact with the tip portion 71A of the lift plate 71 at positions within the range of the central portion 62 in the width direction X. That is, the lift plate 71 supports the longitudinal constricted portions 93, which are part of the third constricted portions 95, at the under surface of the central portion 62.

As illustrated in FIG. 8 and FIG. 9, in the feeding direction FD, the position of the inner end 94A of the second constricted portion 94 is located downstream of the position of the downstream end 95A of the third constricted portion 95. The first constricted portion 96 is the constricted portion that joins the inner end 94A of the second constricted portion 94 and the downstream end 95A of the third constricted portion 95.

Actions of Second Embodiment

As illustrated in FIG. 8, when the hopper 61 is at the first feeding position P1 at the time of the maximum loading amount, the tip portion of the lift plate 71 can support the under surface of the extension portions 64 of the hopper 61 using the first constricted portions 96, at the positions outside the range of the central portion 62 in the width direction X. Compared with a case in which the lift plate 71 supports the hopper 61 at the first feeding position P1 at positions within the range of the central portion 62 in the width direction X, the extension portions 64 of the hopper 61 can be suppressed from being bent downward. Thus, the feeding failure can be suppressed. Further, as illustrated in FIG. 9, when the hopper 61 is at the second feeding position P2 at the time of the minimum loading amount, the tip portion 71A of the lift plate 71 can support the under surface of the extension portions 64 of the hopper 61 at the positions within the range of the central portion 62 in the width direction, using the longitudinal constricted portions 93 which are part of the third constricted portions 95. Compared with a case in which the lift plate 71 supports the hopper 61 at the second feeding position P2 at positions outside the range of the central portion 62 in the width direction X, the swingable range of the hopper 61, that is, the maximum inclination angle of the hopper 61, can be secured to be large. It is thus possible to secure a large maximum number of media M that can be accommodated in the feeding cassette 15.

Third Embodiment

Next, the feeding cassette 15 according to a third embodiment will be described with reference to FIG. 10 and FIG. 11. In the first and second embodiments, the first constricted portion extending in the path including the component in the feeding direction FD is the oblique first constricted portion 92 extending in the straight line and intersecting the feeding direction FD at the acute angle, or the curved first constricted portion 96, but the first constricted portion is not limited to these configurations. As with a first constricted portion 97 according to the third embodiment, the constricted portion may be a longitudinal constricted portion extending in a straight line along a path including only a component in the feeding direction FD. In other words, the first constricted portion 97 may be a longitudinal constricted portion provided in the extension portion 64. Note that the configurations other than the configuration of the constricted portion 97 are the same as those of the first embodiment. Of the constricted portion 90, only a configuration that differs from that of the first and second embodiments will be described below.

Configuration of Constricted Portion 90 According to Third Embodiment

Figure 10:
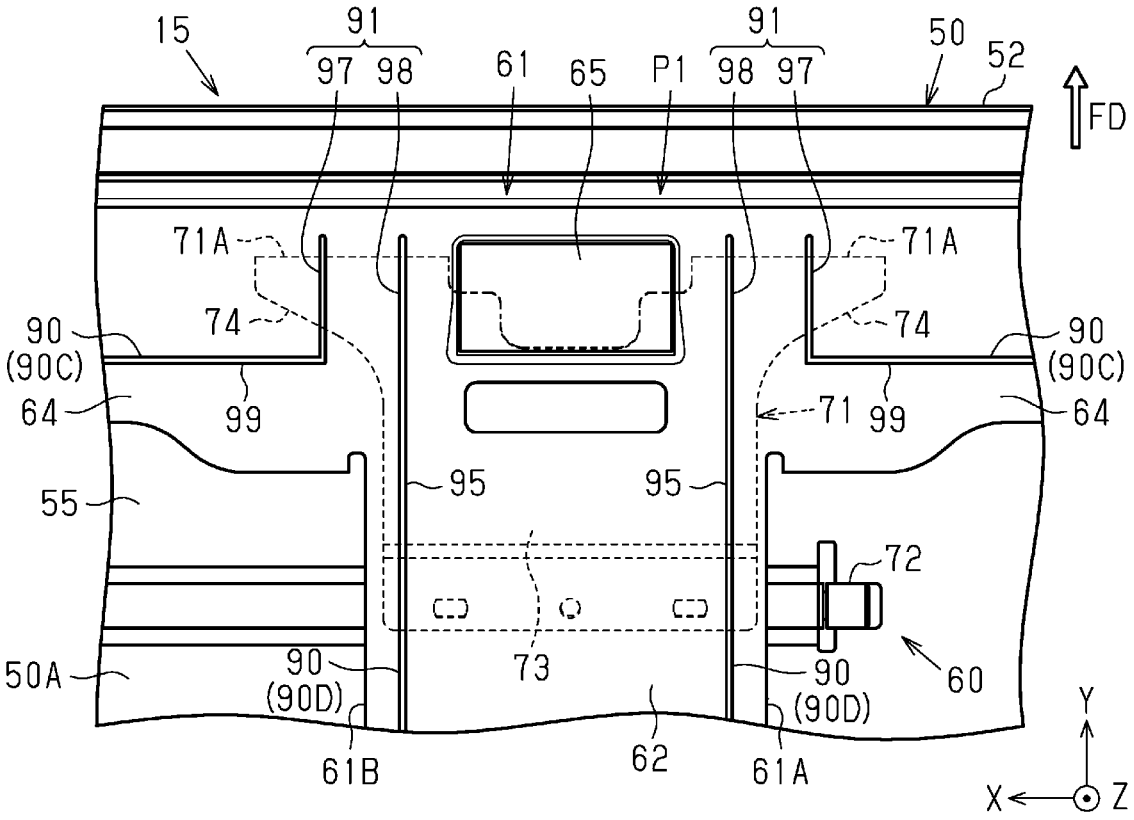
FIG. 10 is a partial plan view illustrating the feeding cassette when the hopper is at the first feeding position, in a third embodiment.
Figure 11:
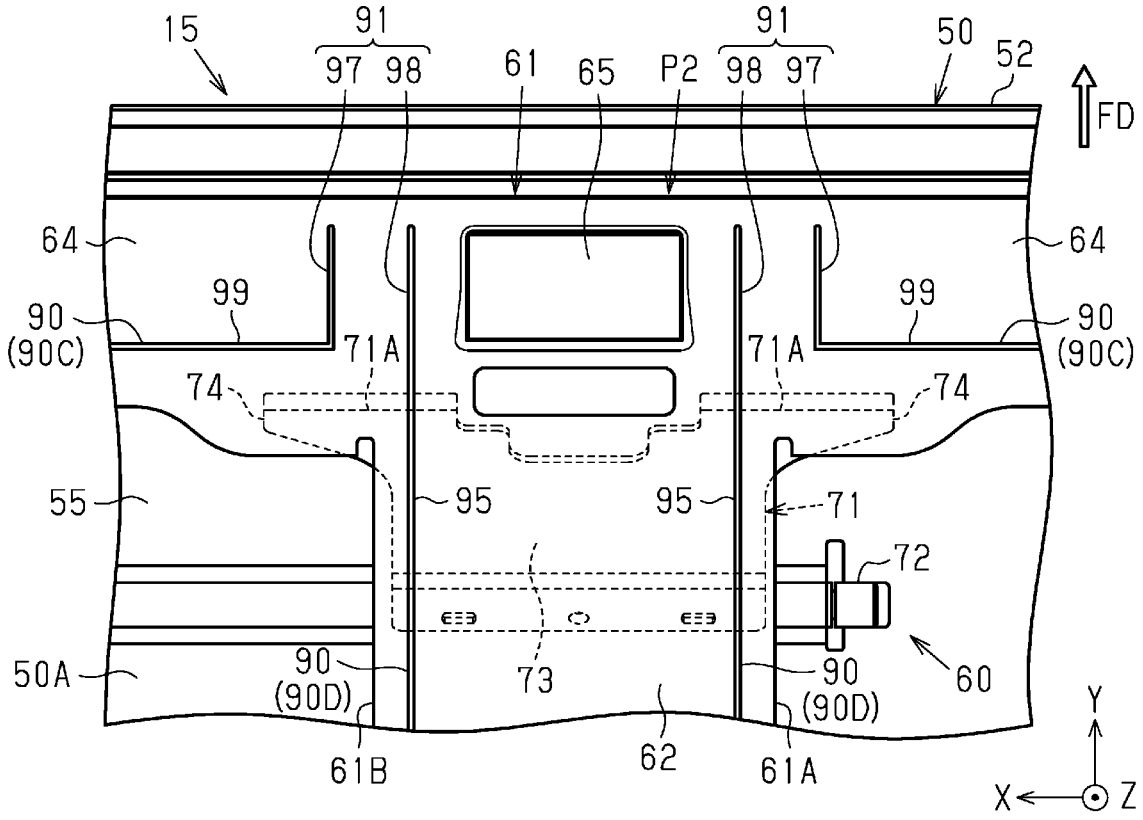
FIG. 11 is a partial plan view illustrating the feeding cassette when the hopper is at the second feeding position.

For example, as illustrated in FIG. 10 and FIG. 11, the hopper 61 includes, as the constricted portion for reinforcement 90, a constricted portion for reinforcement 90C provided in the extension portion 64 and a constricted portion for reinforcement 90D provided in the central portion 62.

As illustrated in FIG. 10 and FIG. 11, the supporting constricted portion 91 may include the first constricted portion 97 provided in the extension portion 64 and a longitudinal constricted portion 98 provided in the central portion 62. The first constricted portion 97 is a constricted portion that is provided in the extension portion 64 and extends in the feeding direction FD. The longitudinal constricted portion 98 is a constricted portion that is provided in the central portion 62 and extends in the feeding direction FD. The supporting constricted portion 91 includes the two constricted portions 97 and 98 respectively extending in the feeding direction FD at different positions in the width direction X. In this way, the supporting constricted portion 91 may be constituted by the plurality of constricted portions 97 and 98. The supporting constricted portion 91 may be constituted in a predetermined path including a plurality of separated paths.

As illustrated in FIG. 10, the supporting constricted portions 91 include the first constricted portions 97 that come into contact with the tip portion 71A of the lift plate 71 at positions outside the range of the central portion 62 in the width direction X, when the hopper 61 is at the first feeding position P1 at which the hopper 61 is inclined at the minimum angle in the swingable range. Further, as illustrated in FIG. 11, the supporting constricted portions 91 include the longitudinal constricted portions 98 that come into contact with the tip portion 71A of the lift plate 71 at positions within the range of the central portion 62 in the width direction X, when the hopper 61 is at the second feeding position P2 at which the hopper 61 is inclined at the maximum angle. The two constricted portions 97 and 98 are both formed as the paths extending along the feeding direction FD. That is, each of the two constricted portions 97 and 98 is the longitudinal constricted portion in which a direction component of the path is only the feeding direction FD.

As illustrated in FIG. 10 and FIG. 11, the upstream end of the first constricted portion 97 is joined to the inner end of the second constricted portion 99. Note that, in the example illustrated in FIG. 10, the first constricted portion 97 and the second constricted portion 99 are joined to each other at a right angle, but may be joined to each other via a constricted portion having an oblique path intersecting the feeding direction FD at an acute angle. Further, a joining portion between the first constricted portion 97 and the second constricted portion 99 may be connected via a constricted portion having an arc-shaped (an R shaped) path.

Further, as illustrated in FIG. 10 and FIG. 11, the longitudinal constricted portion 98 is joined to the third constricted portion 95 in one line. Note that the longitudinal constricted portion 98 may be provided extending in the feeding direction FD at a position different from that of the third constricted portion 95 in the width direction X. In this case, the longitudinal constricted portion 98 may be joined to the third constricted portion 95 via a constricted portion having an oblique path intersecting the feeding direction FD at an acute angle. Further, the longitudinal constricted portion 98 and the third constricted portion 95 may be joined to each other via a constricted portion having an arc-shaped (R-shaped) path.

Actions of Third Embodiment

When the hopper 61 is at the first feeding position P1 at the time of the maximum loading amount, using the first constricted portions 97, the tip portion 71A of the lift plate 71 can support the under surface of the extension portions 64 of the hopper 61 at positions outside the range of the central portion 62 in the width direction X. Further, as illustrated in FIG. 10, when the hopper 61 is located at the first feeding position P1, using the longitudinal constricted portions 98, the tip portion 71A of the lift plate 71 can support the under surface of the extension portions 64 also at positions within the range of the central portion 62 in the width direction X. Compared with a case in which the lift plate 71 supports the hopper 61 at the first feeding position P1 only at positions within the range of the central portion 62 in the width direction X, the extension portions 64 of the hopper 61 can be suppressed from being bent downward. Thus, the feeding failure can be suppressed. Further, when the hopper 61 is at the second feeding position P2 at the time of the minimum loading amount, as illustrated in FIG. 11, using the longitudinal constricted portions 98, the tip portion 71A of the lift plate 71 can support the under surface of the extension portions 64 of the hopper 61 at positions within the range of the central portion 62 in the width direction X. Compared with a case in which the lift plate 71 supports the hopper 61 at the second feeding position P2 at positions outside the range of the central portion 62 in the width direction X, the swingable range of the hopper 61, that is, the maximum inclination angle of the hopper 61, can be secured to be large. Thus, it is possible to secure a large maximum number of sheets (the maximum loading amount) to be accommodated in the feeding cassette 15.

Note that the two constricted portions 97 and 98 may be provided in paths in which the tip portion 71A of the lift plate 71 supports one of the two constricted portions. In this case, if there is a level difference between the two constricted portions 97 and 98, due to a processing error or the like, there is a possibility that vibration or collision may occur in the hopper 61 due to the hopper 61 becoming caught up on the level difference in the process of switching between a state of being supported by the first constricted portion 97 and a state of being supported by the second vertical constricted portion 98. Thus, by forming an inclined surface on at least one of the two constricted portions 97 and 98 at a portion at which the switching is performed, it is possible to suppress the hopper 61 from becoming caught up as can happen in the switching between the constricted portions supported by the lift plate 71. When the inclined surface is provided at the upstream end portion of the first constricted portion 97, the inclined surface may be configured such that the protruding height thereof becomes lower in the downward direction the further upstream in the feeding direction FD. Further, when the inclined surface is provided at the downstream end portion of the longitudinal constricted portion 98, the inclined surface may be configured such that the protruding height thereof becomes lower in the downward direction the further downstream in the feeding direction FD.

Modified Examples

The embodiment can be modified and implemented as follows. The embodiment and the following modified examples can be combined with each other and implemented insofar as no technological contradictions arise.

- A configuration may be adopted in which the supporting constricted portion 91 is formed only in the extension portion 64 of the hopper 61. In the first and second embodiments, the first constricted portions 92 and 96 may be formed by a path including a straight line path portion and a curved path portion.
- In the first and second embodiments, a configuration is adopted in which the inner end of the second constricted portion 94 is located downstream of the downstream end of the third constricted portion 95, and the first constricted portions 92 and 96 join the inner end of the second constricted portion 94 and the downstream end of the third constricted portion 95, but they may be joined by paths other than the paths of each of these embodiments. For example, the first constricted portion that joins the inner end of the second constricted portion 94 to the downstream end of the third constricted portion 95 may be formed in a crank-shaped path. In other words, in the first constricted portion, after a longitudinal constricted portion bending at a right angle from the inner end of the second constricted portion 94 and extending in the feeding direction FD is formed, a horizontal constricted portion bending once more at a right angle and extending to the inner side in the width direction X is formed, and a longitudinal constricted portion further bending at a right angle and extending in the feeding direction FD is formed, thus joining to the downstream end of the third constricted portion 95. Note that the number of longitudinal constricted portions constituting the first constricted portion is not limited to two, and may be three or more.
- In the first embodiment, the first constricted portion 92 is the single straight line constricted portion. However, the first constricted portion 92 may be formed in a bent linear path in which two or three or more straight line constricted portions are joined to each other. In this case, the paths may be formed as the paths by which the interval between the outermost two points at which the lift plate 71 supports the hopper 61 becomes narrower the further upstream in the feeding direction FD.
- In the first embodiment, the supporting constricted portion 91 may be configured to include only the straight line first constricted portion 92 and not the longitudinal constricted portion 93 that is a part of the third constricted portion 95. In this case, the lift plate 71 may be formed in a plate shape having the same width from the base end portion on the rotational fulcrum side to the tip portion 71A.
- In the second embodiment, the supporting constricted portion 91 may be configured to include only the curved first constricted portion 96 and not the longitudinal constricted portion 93 which is a part of the third constricted portion 95. In this case, the lift plate 71 may be formed in a plate shape having the same width from the base end portion on the rotational fulcrum side to the tip portion 71A.
- In the third embodiment, of the first constricted portion 97 and the longitudinal constricted portion 98 that are the longitudinal constricted portions, the lift plate 71 may be configured to support only the first constricted portion 97. According to this configuration, the angle of the swingable range of the hopper becomes narrower, and the number of media M that can be accommodated at the maximum loading amount becomes relatively smaller, but the bending of the extension portion 64 can be suppressed.
- In the third embodiment, the number of the longitudinal constricted portions is not limited to two, and may be three or more. For example, two or more of the longitudinal constricted portions may be disposed further to the outer side in the width direction X than the reinforcing third constricted portion 95.

The recording device 11 is not limited to being the ink-jet printer, and may be an electrophotographic printer, such as a laser printer. Further, the recording device 11 may be a dot impact type printer or a thermal transfer type printer. That is, the recording method of the recording unit 40 is not limited to the ink-jet recording method, and may be configured to perform the recording by another recording method, including an electrophotographic method such as a laser recording method using toner, a dot impact recording method, a thermal recording method, or the like.

The recording device 11 is not limited to being the line printer or the serial printer, and may be a page printer.

The recording device 11 may be a printer having only the recording function without including the scanner unit 20 (image reading unit).

Definitions

The supporting constricted portion according to the present specification includes both the configuration in which the constricted portions are formed only in the extension portions of the hopper, and the configuration in which the constricted portions are formed in both the extension portions and the central portion of the hopper.

Hereinafter, technical concepts and the actions and effects thereof that are understood from the above-described embodiments and modified examples will be described.

(A) The feeding cassette includes the cassette body that can accommodate the media in the stacked state, the hopper being disposed in the cassette body and the medium being stacked on the hopper, and the hopper being swingable with respect to the cassette body, the side guides that regulate the position of the medium in the width direction and are movable in the width direction, and the lift plate that rotates about the rotational movement shaft parallel to the width direction with the one end portion of the lift plate serving as the rotational fulcrum, to support the under surface of the hopper from below and move the hopper upward, using the tip portion that is the end portion on the opposite end from the rotational fulcrum. The hopper includes the central portion positioned at the center in the width direction, and the extension portions extending to both sides in the width direction from the downstream portion of the central portion in the feeding direction in which the medium is fed. The hopper includes the constricted portion for reinforcement, which protrudes to the under side, in at least the extension portion, and in the swingable range of the hopper, the constricted portion for reinforcement includes the supporting constricted portion with which the tip portion comes into contact when the tip portion of the lift plate supports the under surface of the hopper. The supporting constricted portion includes the first constricted portion in a path including a component in the feeding direction and at least a part of the first constricted portion is provided in the extension portion. The lift plate supports the first constricted portion over at least a part of the swingable range of the hopper.

According to this configuration, firstly, since the constricted portion for reinforcement is provided in the extension portion of the hopper, the rigidity of the extension portion can be increased. Secondly, since the first constricted portion is the path including the component in the feeding direction, the lift plate can support the extension portion via at least the part of the first constricted portion provided in the extension portion, over the range in which the support position of the hopper by the lift plate changes in the feeding direction between the raised position and the lowered position. Accordingly, compared to a case in which the lift plate supports only the central portion of the hopper, it is possible to suppress the extension portion of the hopper from being bent downward. Thus, it is possible to suppress the feeding failure of the medium.

(B) In the above-described feeding cassette, in the extension portion, the constricted portion for reinforcement may include the second constricted portion that is joined to the first constricted portion and extends in the path including the component in the width direction. According to this configuration, since the second constricted portion is provided as the constricted portion for reinforcement, the rigidity of the extension portion of the hopper can be further increased.

(C) In the above-described feeding cassette, in the central portion, the hopper may include, as the constricted portion for reinforcement, the third constricted portion extending in the feeding direction.

According to this configuration, by providing the third constricted portion, the rigidity of the central portion of the hopper can be increased. Thus, deformation of the hopper in the feeding direction can be suppressed.

(D) In the above-described feeding cassette, the first constricted portion may be joined to the third constricted portion extending in the central portion of the hopper. According to this configuration, since the two or more constricted portions are joined together to constitute the single constricted portion, the rigidity of the periphery of the hopper where the constricted portions are formed can be increased.

(E) In the above-described feeding cassette, in the feeding direction, the position of the inner end of the second constricted portion may be located downstream of the position of the downstream end of the third constricted portion, and the first constricted portion may be the constricted portion joining the inner end of the second constricted portion and the downstream end of the third constricted portion.

According to this configuration, since the three constricted portions are joined together to constitute the single constricted portion, the constricted portions can be disposed in a small space. For example, since the drawing process is easy, it is possible to reduce the product cost by reducing the processing cost.

(F) In the above-described feeding cassette, the first constricted portion may be the constricted portion extending in the straight line or may be the constricted portion extending in the curved shape.

According to this configuration, the lift plate can support the extension portion at two points with the increasingly wider interval therebetween the greater the medium loading amount on the hopper. Thus, it is possible to effectively suppress the bending of the extension portion due to the weight of the medium.

(G) In the above-described feeding cassette, the pair of supporting constricted portions may be provided on both sides of the width center of the hopper, the pair of the supporting constricted portions being provided over a range including a part of each of the first constricted portion and the third constricted portion. The interval in the width direction between the pair of constricted portions supported by the lift plate may be widest when the hopper is at the first feeding position at the time of the maximum loading amount.

According to this configuration, the lift plate can support the pair of first constricted portions with the widest gap therebetween in the width direction at the time of the maximum loading amount on the hopper. Thus, even when the total weight of the stacked media on the hopper is large at the time of the maximum loading amount or a large loading amount close to the maximum loading amount, the bending of the extension portion can be effectively suppressed. On the other hand, thereafter, in the process in which the lift plate moves to the highest position, the number of the media stacked on the hopper decreases. For this reason, even though the support position of the lift plate switches to the third constricted portion at the central portion, the total weight of the stacked media is small, and thus the deformation, such as the bending, of the extension portion of the hopper is suppressed.

(H) In the above-described feeding cassette, the rotational movement shaft of the lift plate may be disposed upstream of the extension portion in the feeding direction. In plan view from a direction perpendicular to a stacking surface when the hopper is at a retracted position at which the hopper is lowered to a greatest extent, the lift plate may be covered by the hopper when the lift plate is at a maximum raised position and at a maximum lowered position.

According to this configuration, the side guide can be disposed close to the extension portion and the central portion of the hopper. That is, since the side guide can be disposed more downstream in the feeding direction, it is possible to suppress the medium from being fed in the skewed manner.

(I) The recording device includes the above-described feeding cassette, and the recording unit that performs the recording on the medium fed from the feeding cassette.

According to this configuration, in the recording device, the same effects can be obtained as in the above-described feeding cassette.

What is claimed is:

1. A feeding cassette comprising:

a cassette body configured to accommodate a medium in a stacked state;

a hopper disposed in the cassette body, the medium being stacked on the hopper, and the hopper being configured to swing with respect to the cassette body;

a side guide configured to regulate a position of the medium in a width direction and to move in the width direction; and a lift plate configured to rotate around a rotational movement shaft parallel to the width direction with one end portion of the lift plate serving as a rotational fulcrum, to support an under surface of the hopper from below and move the hopper upward, using a tip portion, the tip portion being an end portion of the lift plate on an opposite end from the rotational fulcrum, wherein the hopper includes a central portion positioned at a center in the width direction, and an extension portion extending to both sides in the width direction from a downstream portion of the central portion in a feeding direction in which the medium is fed, the hopper includes a constricted portion for reinforcement protruding to an under side, in at least the extension portion, the constricted portion for reinforcement includes a supporting constricted portion with which the tip portion of the lift plate comes into contact when supporting the under surface of the hopper in a swingable range of the hopper, the supporting constricted portion includes a first constricted portion in a path including a component in the feeding direction, at least a part of the first constricted portion being provided in the extension portion, the lift plate supports the first constricted portion over at least a part of the swingable range of the hopper, the rotational movement shaft of the lift plate is disposed upstream of the extension portion in the feeding direction, and in plan view from a direction perpendicular to a stacking surface when the hopper is at a retracted position at which the hopper is lowered to a greatest extent, the lift plate is covered by the hopper when the lift plate is at a maximum raised position and at a maximum lowered position.

2. The feeding cassette according to claim 1, wherein at the extension portion, the constricted portion for reinforcement includes a second constricted portion joined to the first constricted portion and extending in a path including a component in the width direction.

3. The feeding cassette according to claim 2, wherein in the central portion, the hopper includes, as the constricted portion for reinforcement, a third constricted portion extending in the feeding direction.

4. The feeding cassette according to claim 3, wherein the first constricted portion is joined to the third constricted portion extending in the central portion of the hopper.

5. The feeding cassette according to claim 4, wherein in the feeding direction, a position of an inner end of the second constricted portion is located downstream of a position of a downstream end of the third constricted portion, and the first constricted portion is a constricted portion joining the inner end of the second constricted portion and the downstream end of the third constricted portion.

6. The feeding cassette according to claim 5, wherein the first constricted portion is a constricted portion extending in a straight line, or a constricted portion extending in a curved shape.

7. The feeding cassette according to claim 5, wherein a pair of the supporting constricted portions are provided on both sides of a width center of the hopper, the pair of the supporting constricted portions being provided over a range including part of each of the first constricted portion and the third constricted portion, and an interval in the width direction between the pair of constricted portions supported by the lift plate is widest when the hopper is at a first feeding position at a time of a maximum loading amount.

8. A recording device comprising:

the feeding cassette according to claim 1; and a recording unit configured to perform recording on a medium fed by the feeding cassette.

9. A feeding cassette comprising:

a cassette body configured to accommodate a medium in a stacked state;

a hopper disposed in the cassette body, the medium being stacked on the hopper, and the hopper being configured to swing with respect to the cassette body;

a side guide configured to regulate a position of the medium in a width direction and to move in the width direction; and a lift plate configured to rotate around a rotational movement shaft parallel to the width direction with one end portion of the lift plate serving as a rotational fulcrum, to support an under surface of the hopper from below and move the hopper upward, using a tip portion, the tip portion being an end portion of the lift plate on an opposite end from the rotational fulcrum, wherein the hopper includes a central portion positioned at a center in the width direction, and an extension portion extending to both sides in the width direction from a downstream portion of the central portion in a feeding direction in which the medium is fed, the hopper includes a constricted portion for reinforcement protruding to an under side, in at least the extension portion, the constricted portion for reinforcement includes a supporting constricted portion with which the tip portion of the lift plate comes into contact when supporting the under surface of the hopper in a swingable range of the hopper, the supporting constricted portion includes a first constricted portion in a path including a component in the feeding direction, at least a part of the first constricted portion being provided in the extension portion, the lift plate supports the first constricted portion over at least a part of the swingable range of the hopper, and at the extension portion, the constricted portion for reinforcement includes a second constricted portion joined to the first constricted portion and extending in a path including a component in the width direction.

10. The feeding cassette according to claim 9, wherein in the central portion, the hopper includes, as the constricted portion for reinforcement, a third constricted portion extending in the feeding direction.

11. The feeding cassette according to claim 10, wherein the first constricted portion is joined to the third constricted portion extending in the central portion of the hopper.

12. The feeding cassette according to claim 11, wherein in the feeding direction, a position of an inner end of the second constricted portion is located downstream of a position of a downstream end of the third constricted portion, and the first constricted portion is a constricted portion joining the inner end of the second constricted portion and the downstream end of the third constricted portion.

13. The feeding cassette according to claim 12, wherein the first constricted portion is a constricted portion extending in a straight line, or a constricted portion extending in a curved shape.

14. The feeding cassette according to claim 12, wherein a pair of the supporting constricted portions are provided on both sides of a width center of the hopper, the pair of the supporting constricted portions being provided over a range including part of each of the first constricted portion and the third constricted portion, and an interval in the width direction between the pair of constricted portions supported by the lift plate is widest when the hopper is at a first feeding position at a time of a maximum loading amount.

15. A recording device comprising:

the feeding cassette according to claim 9; and a recording unit configured to perform recording on a medium fed by the feeding cassette.

* * * * *